US009033444B2

(12) United States Patent
Okuda et al.

(10) Patent No.: US 9,033,444 B2
(45) Date of Patent: May 19, 2015

(54) INK JET PRINTING APPARATUS

(75) Inventors: Ippei Okuda, Shiojiri (JP); Tsuyoshi Sano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 31 days.

(21) Appl. No.: 13/554,203

(22) Filed: Jul. 20, 2012

(65) Prior Publication Data

US 2013/0021401 A1 Jan. 24, 2013

(30) Foreign Application Priority Data

Jul. 22, 2011 (JP) ..... 2011-160725

(51) Int. Cl.
*B41J 29/38* (2006.01)
*B41J 2/21* (2006.01)

(52) U.S. Cl.
CPC ..... *B41J 2/2117* (2013.01)

(58) Field of Classification Search
CPC ..... B41J 2/205; B41J 29/38
See application file for complete search history.

(56) References Cited

U.S. PATENT DOCUMENTS

| | | | | |
|---|---|---|---|---|
| 6,149,263 | A * | 11/2000 | Nakano | 347/43 |
| 7,244,021 | B2 * | 7/2007 | Arai | 347/102 |
| 7,407,277 | B2 | 8/2008 | Yoneyama | |
| 7,718,235 | B2 | 5/2010 | Uerz et al. | |
| 2004/0189772 | A1 * | 9/2004 | Arai | 347/102 |
| 2005/0235870 | A1 | 10/2005 | Ishihara | |
| 2006/0189712 | A1 * | 8/2006 | Kondo | 523/160 |
| 2007/0044684 | A1 | 3/2007 | Nakano et al. | |
| 2010/0053247 | A1 * | 3/2010 | Kakutani | 347/12 |
| 2010/0086690 | A1 | 4/2010 | Aoki | |
| 2011/0102488 | A1 * | 5/2011 | Usuda et al. | 347/14 |
| 2011/0221814 | A1 * | 9/2011 | Tamai et al. | 347/14 |
| 2011/0234660 | A1 * | 9/2011 | Yoshida | 347/9 |
| 2012/0156449 | A1 | 6/2012 | Tateishi et al. | |

FOREIGN PATENT DOCUMENTS

| | | | |
|---|---|---|---|
| JP | 2002-225255 | A | 8/2002 |
| JP | 2004-195451 | A | 7/2004 |
| JP | 2010-076102 | A | 4/2010 |
| JP | 2011-020382 | A | 2/2011 |
| JP | 2011-051110 | A | 3/2011 |
| WO | 2011-027842 | A1 | 3/2011 |

* cited by examiner

*Primary Examiner* — Manish S Shah
*Assistant Examiner* — Jeremy Delozier
(74) *Attorney, Agent, or Firm* — Nutter McClennen & Fish LLP; John J. Penny, Jr.; Rory P. Pheiffer

(57) ABSTRACT

An ink jet printing apparatus includes a head that is provided with nozzle holes for ejecting ink, and a control unit that performs a plurality modes, and the plurality of modes includes a first image printing mode of ejecting white-based ink from the nozzle holes to adhere the white-based ink to a first area of a printing medium and a second area different from the first area to print an image, and a second image printing mode of substantially concurrently ejecting color ink and resin ink from the nozzle holes to contact and adhere the color ink and the resin ink onto the white-based ink of the first area to print an image, and ejecting resin ink from the nozzle holes to adhere the resin ink onto the white-based ink composition of the second area to print an image.

20 Claims, 8 Drawing Sheets

INK JET PRINTING APPARATUS

Priority is claimed under 35 U.S.C. §119 to Japanese Application No. 2011-160725 filed on Jul. 22, 2011, is hereby incorporated by reference in its entirety.

BACKGROUND

1. Technical Field

The present invention relates to an ink jet printing apparatus.

2. Related Art

Hitherto, an ink jet printing apparatus having nozzle holes for ejecting ink as liquid droplets has been known. Recently, various kinds of ink are used to obtain a desired image using such an ink jet printing apparatus.

For example, in JP-A-2004-195451, a method is disclosed in which an image is printed on a printing medium using an ink composition (hereinafter, also referred to as "color ink composition") containing a color material, and then the image is coated with an ink composition (hereinafter, also referred to as "resin ink composition") which does not contain the color material.

Meanwhile, a white-based ink composition containing a white pigment of the ink may be used to remove a base color to improve a coloring property of a color image, for example, when a color image is printed on a printing medium, a base color of which is not white such as a plastic product or a metal product. When a color image is printed on a transparent sheet, it may be used to form a white shielding layer for decreasing transparency of the color image.

However, when a white image formed of a white-based ink composition is printed on the printing medium, then a color image formed of a color ink composition is formed on the white image, and the color image is coated with a resin ink composition to improve abrasion resistance of the color image, a printing speed of the image may decrease. In this case, specifically, the printing medium has to pass at least three times to coat the printed resin composition of the printed color image of the white image.

Also, on the printing medium, areas where only the white image is printed and the color image and a clear image are not printed may have insufficient abrasion resistance.

SUMMARY

An advantage of some aspects of the invention is to provide an ink jet printing apparatus capable of printing an image in which a printing speed of the image is high and abrasion resistance is excellent.

The invention can be realized in the following forms or application examples.

Application Example 1

According to an aspect of the invention, there is provided an ink jet printing apparatus including: a head that is provided with nozzle holes for ejecting ink; and a control unit that performs a plurality of modes, wherein the plurality of modes includes a first image printing mode of ejecting a white-based ink composition from the nozzle holes to adhere the white-based ink composition to a first area of a printing medium and a second area different from the first area to print an image, and a second image printing mode of substantially concurrently ejecting a color ink composition and a resin ink composition from the nozzle holes to contact and adhere the color ink composition and the resin ink composition onto the white-based ink composition of the first area to print an image, and ejecting the resin ink composition from the nozzle holes to adhere the resin ink composition onto the white-based ink composition of the second area to print an image, wherein the white-based ink composition contains a white-based color material, wherein the color ink composition contains resin and a color material other than the white-based color material, and wherein the resin ink composition contains resin, and does not substantially contain a color material.

According to the aspect of Application Example 1, it is possible to print an image in which a printing speed of the image is high and abrasion resistance is excellent.

Application Example 2

According to another aspect of the invention, there is provided an ink jet printing apparatus including: a head that is provided with nozzle holes for ejecting ink; and a control unit that performs a plurality of modes, wherein the plurality of modes includes a fourth image printing mode of ejecting a white-based ink composition from the nozzle holes to adhere the white-based ink composition to a first area of a printing medium to print an image, and substantially concurrently ejecting the white-based ink composition and a resin ink composition from the nozzle holes to contact and adhere the white-based ink composition and the resin ink composition to a second area of the printing medium different from the first area to print an image, and a fifth image printing mode of substantially concurrently ejecting a color ink composition and the resin ink composition from the nozzle holes to contact and adhere the color ink composition and the resin ink composition onto the white-based ink composition of the first area to print an image, wherein the white-based ink composition contains a white-based color material, wherein the color ink composition contains a color material other than the white-based color material and resin, and wherein the resin ink composition contains resin, and does not substantially contain a color material.

According to the aspect of Application Example 2, it is possible to print an image in which a printing speed of the image is high and abrasion resistance is excellent.

Application Example 3

According to still another aspect of the invention, there is provided an ink jet printing apparatus including: a head that is provided with nozzle holes for ejecting ink; and a control unit that controls and performs a plurality of modes, wherein the plurality of modes includes a seventh image printing mode of substantially concurrently ejecting the white-based ink composition and a resin ink composition from the nozzle holes to contact and adhere the white-based ink composition and the resin ink composition to a first area of the printing medium and a second area of the printing medium different from the first area, and an eighth image printing mode of substantially concurrently ejecting a color ink composition and the resin ink composition from the nozzle holes to contact and adhere the color ink composition and the resin ink composition onto the white-based ink composition and the resin ink composition of the first area to print an image, wherein the white-based ink composition contains a white-based color material, wherein the color ink composition contains a color material other than the white-based color material and resin, and wherein the resin ink composition contains resin, and does not substantially contain a color material.

According to the aspect of Application Example 3, it is possible to print an image in which a printing speed of the image is high and abrasion resistance is excellent.

Application Example 4

The ink jet printing apparatus according to Application Example 1 may further include a carriage that scans the head in a main scanning direction, wherein in the second image printing mode, the printing of the image in the first area and the printing of the image in the second area may be performed at the time of the same carriage scan.

Application Example 5

The ink jet printing apparatus according to Application Example 4 may further include a first nozzle row that is formed by arranging the plurality of nozzle holes for ejecting the white-based ink composition in a sub-scanning direction intersecting the main scanning direction; a second nozzle row that is formed by arranging the plurality of nozzle holes for ejecting the color ink composition in the sub-scanning direction; and a third nozzle row that is formed by arranging the plurality of nozzle holes for ejecting the resin ink composition in the sub-scanning direction, wherein the first nozzle row, the second nozzle row, and the third nozzle row may be divided into groups including a predetermined number of nozzle holes for each group in the sub-scanning direction, wherein the group may include a first group on the upstream side in the sub-scanning direction and a second group further to the downstream side in the sub-scanning direction than the first group, wherein the first image printing mode may be performed by ejecting the white-based ink composition from the first group of the first nozzle row, and wherein the second image printing mode may be performed by ejecting the color ink composition from the second group of the second nozzle row, and ejecting the resin ink composition from the second group of the third nozzle row.

Application Example 6

In the ink jet printing apparatus according to any one of Application example 1, Application Example 4, and Application Example 5, the plurality of modes may include a third image printing mode of ejecting the color ink composition from the nozzle holes to adhere the color ink composition onto the white-based ink composition of the first area to print an image, and ejecting the resin ink composition from the nozzle holes to adhere the resin ink composition onto the white-based ink composition of the second area to print an image, and the third image printing mode may be performed instead of the second image printing mode when the amount of the resin in the color ink composition adhered to the first area is equal to or more than 0.03 mg/in$^2$.

Application Example 7

The ink jet printing apparatus according to Application example 2 may further include a carriage that scans the head in the main scanning direction, wherein in the fourth image printing mode, the printing of the image in the first area and the printing of the image in the second area are performed at the time of the same carriage scan.

Application Example 8

The ink jet printing apparatus according to Application Example 7 may further include: a first nozzle row that formed by arranging the plurality of nozzle holes for ejecting the white-based ink composition in a sub-scanning direction intersecting the main scanning direction; a second nozzle row that is formed by arranging the plurality of nozzle holes for ejecting the color ink composition in the sub-scanning direction; and a third nozzle row that is formed by arranging the plurality of nozzle holes for ejecting the resin ink composition in the sub-scanning direction, wherein the first nozzle row, the second nozzle row, and the third nozzle row are divided into groups may include a predetermined number of nozzle holes in the sub-scanning direction, wherein the group may include a first group on the upstream side in the sub-scanning direction and a second group further to the downstream side in the sub-scanning direction than the first group, wherein the fourth image printing mode may be performed by ejecting the white-based ink composition from the first group of the first nozzle row, and ejecting the resin ink composition from the first group of the third nozzle row, and wherein the fifth image printing mode may be performed by ejecting the color ink composition from the second group of the second nozzle row, and ejecting the resin ink composition from the second group of the third nozzle row.

Application Example 9

In the ink jet printing apparatus according to any one of Application Example 2, Application Example 7, and Application Example 8, the plurality of modes further include a sixth image printing mode of ejecting the color ink composition from the nozzle holes to adhere the color ink composition onto the white-based ink composition of the first area to print an image, and the sixth image printing mode may be performed instead of the fifth image printing mode when the amount of the resin in the color ink composition adhered to the first area is equal to or more than 0.03 mg/in$^2$.

Application Example 10

The ink jet printing apparatus according to Application Example 3 may further include: a carriage that scans the head in a main scanning direction; a first nozzle row that is formed by arranging the plurality of nozzle holes for ejecting the white-based ink composition in a sub-scanning direction intersecting the main scanning direction; and a second nozzle row that is formed by arranging the plurality of nozzle holes for ejecting the color image composition in the sub-scanning direction, and a third nozzle row that is formed by arranging the plurality of nozzle holes for ejecting the resin ink composition in the sub-scanning direction, wherein the first nozzle row, the second nozzle row, and the third nozzle row may be divided into groups including a predetermined number of nozzle holes in the sub-scanning direction, wherein the group may include a first group on the upstream side in the sub-scanning direction and a second group further to the downstream side in the sub-scanning direction than the first group, wherein the seventh image printing mode may be performed by ejecting the white-based ink composition from the first group of the first nozzle row, and ejecting the resin ink composition from the first group of the third nozzle row, and wherein the eighth image printing mode may be performed by ejecting the color image composition from the second group of the second nozzle row, and ejecting the resin ink composition from the second group of the third nozzle row.

Application Example 11

In the ink jet printing apparatus according to Application Example 3 or Application Example 10, the plurality of modes may further include a ninth image printing mode of ejecting the color ink composition from the nozzle holes to adhere the color ink composition onto the white-based ink composition and the resin ink composition of the first area to print an image, and the ninth image printing mode may be performed instead of the eighth image printing mode when the amount of the resin in the color ink composition adhered to the first area is equal to or more than 0.03 mg/in$^2$.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
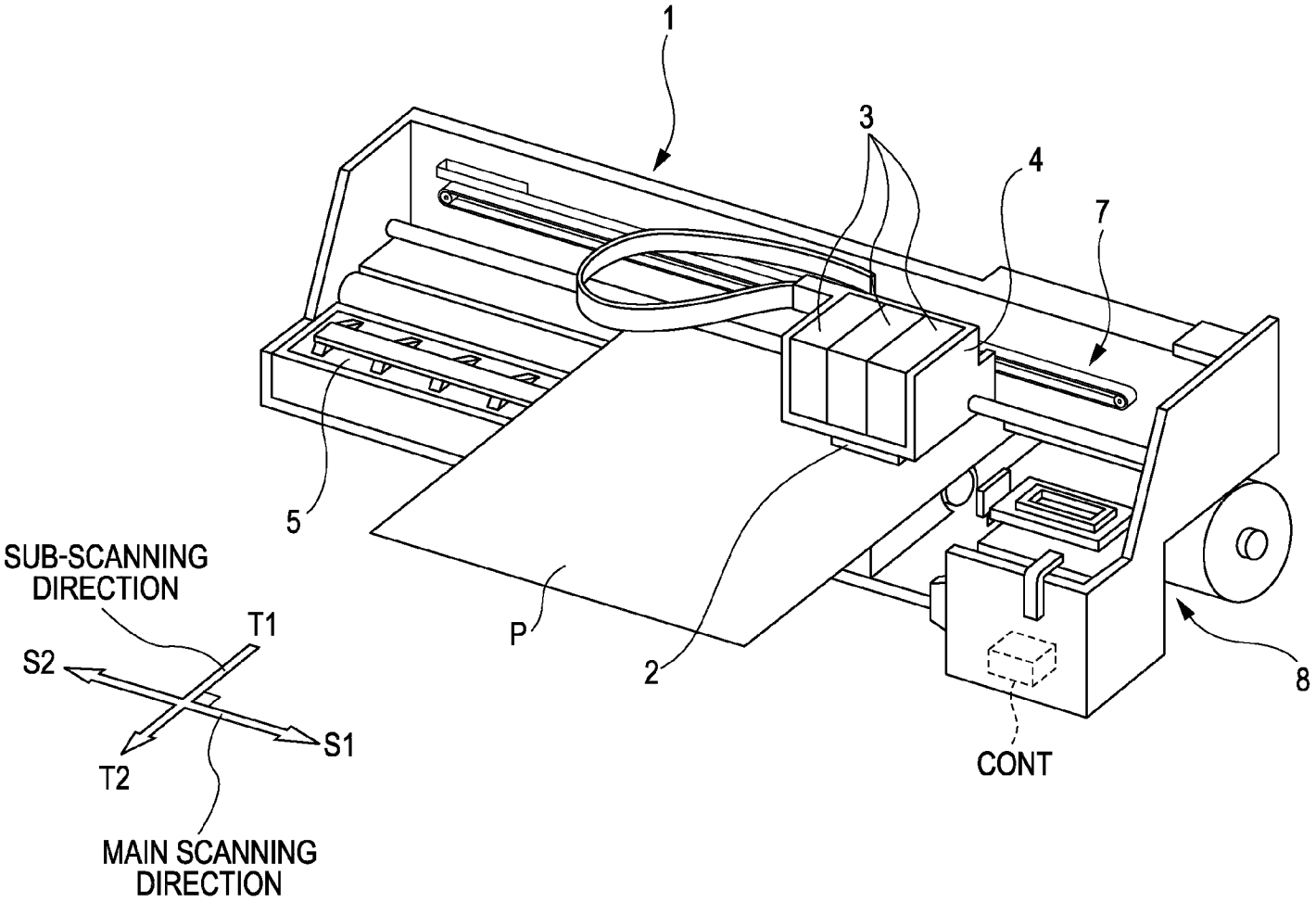
FIG. 1 is a perspective view illustrating a configuration of a printer.

Hereinafter, preferred embodiments of the invention will be described. In the embodiments to be described hereinafter describe an example of the invention. The invention is not limited to the following embodiments, and includes various modification examples embodied in the scope which does not deviate from the main concept of the invention. All the configurations described in the following embodiments are not necessarily essential constituent requirements.

1. Ink Jet Printing Apparatus

An ink jet printing apparatus according to the embodiment includes a head that is provided with nozzle holes for ejecting ink, and a control unit that performs a plurality of modes.

1.1. Apparatus Configuration

The ink jet printing apparatus according to the embodiment will be described with referent to FIG. 1 and FIG. 2. In the drawings used in the following description, scales of members are appropriately modified to make the members have recognizable sizes. In the embodiment, an ink jet printer (hereinafter, merely referred to as "printer") is exemplified as the ink jet printing apparatus. Although it will be described later in detail, the invention is not limited to this apparatus configuration.

FIG. 1 is a perspective view illustrating a printer 1 in the embodiment. The printer 1 shown in FIG. 1 is a serial printer. The serial printer means that a head is mounted on a carriage that moves in a predetermined direction, the head is moved according to the movement of the carriage, and liquid droplets are ejected onto a printing medium.

As shown in FIG. 1, the printer 1 includes a carriage 4 on which the head 2 is mounted and an ink cartridge 3 is detachably mounted, a platen 5 that is provided under the head 2 and on which a printing medium P is transported, a carriage moving mechanism 7 that moves the carriage 4 in a medium width direction of the printing medium P, and a medium transport mechanism 8 that transports the printing medium P in a medium transport direction. The printer 1 controls the whole operation of the printer 1, and has a control unit CONT that performs a plurality of image printing modes. The medium width direction is a main scanning direction (a head scanning direction). The medium transport direction is a sub-scanning direction (a direction perpendicular to the main scanning direction).

The control unit CONT may have a command information receiving unit that receives command information. The command information is output on the basis of an operation of an operation receiving unit by a user (for example, a touch panel and an operation button provided on the printer 20, and a keyboard such as a PC connected to the printer 20), and is received by the command information receiving unit. The command information may be, for example, an execution command of an image printing mode to be described later.

The control unit CONT may have a command executing unit that receives the command information output from the command information receiving unit and performs an execution operation. The command executing unit performs an execution operation of controlling an execution timing of each operation of the carriage 4, the head 2, the carriage moving mechanism 7, and the medium transport mechanism 8 described above or cooperating with them.

The head 2 ejects an ink composition that is liquid droplets with a small diameter from nozzle holes 17 to adhere the ink composition onto the printing medium P. The head 2 is not particularly limited when the head 2 has the function described above, and any ink jet printing method may be used. The ink jet printing method of the head 2 may be, for example, a method of applying strong electric field between nozzles and an acceleration electrode placed in front of the nozzles, continuously ejecting ink of liquid droplets from the nozzles, and applying a printing information signal to polarization electrodes to perform printing while the liquid droplets of the ink flies between the polarization electrodes, a method (an electrostatic attraction method) of ejecting liquid droplets of ink corresponding to a printing information signal without polarizing the liquid droplets of the ink, a method of adding pressure to the ink liquid by a small pump, and mechanically vibrating nozzles by a crystal oscillator or the like to compulsorily eject the liquid droplets of the ink, a method (a piezoelectric method) of adding pressure and a printing information signal to ink by a piezoelectric element to eject and print the liquid droplets of the ink, and a method (a thermal jet method) of heating and foaming the ink to a small electrode according to a printing information signal to eject and print the ink droplets.

Figure 2:
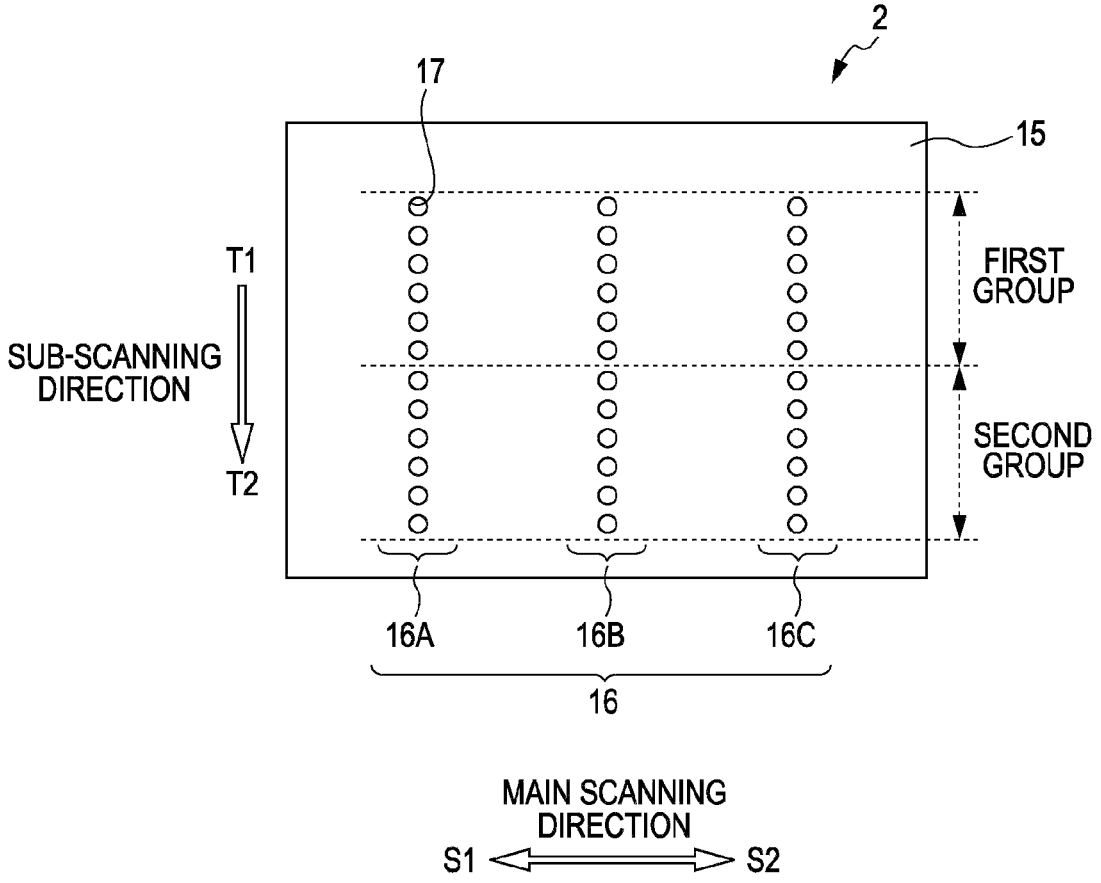
FIG. 2 is a schematic diagram illustrating a nozzle face of a head.

FIG. 2 is a schematic diagram illustrating a nozzle face 15 of the head 2 according to the embodiment. As shown in FIG. 2, the head 2 is provided with the nozzle face 15. On the nozzle face 15 that is also an ejection face of the ink, a plurality of nozzle rows 16 are arranged. The plurality of nozzle rows 16 have a plurality of nozzle holes 17 for ejecting ink for each nozzle row.

The plurality of nozzle rows 16 can eject ink with a different composition for each nozzle row. In the example shown in FIG. 2, three nozzle rows are arranged according to the composition of the ink, and each nozzle row is arranged along the main scanning direction. Specifically, the nozzle rows are formed of a nozzle row 16A capable of ejecting a white-based ink composition, a nozzle row 16B capable of ejecting a color ink composition, and a nozzle row 16C capable of ejecting a resin ink composition.

In the example shown in FIG. 2, the nozzle rows 16A to 16C are arranged on the nozzle face 15 in the sub-scanning direction intersecting the main scanning direction, but the invention is not limited thereto, and the nozzle rows 16A to 16C may be disposed at an angle in a direction intersecting the main scanning direction in the nozzle face 15.

The plurality of nozzle holes 17 are arranged in a predetermined pattern to form the nozzle row. In the embodiment, the plurality of nozzle holes 17 are arranged on the nozzle face 15 in the sub-scanning direction, but the invention is not limited thereto, and for example, the nozzle holes 17 may be disposed in zigzag along the direction perpendicular to the main scanning direction on the nozzle face 15. The number of nozzle holes 17 constituting the nozzle row is not particularly limited.

The plurality of nozzle rows 16 may be divisionally used into a plurality of areas including a predetermined number of nozzle holes 17 in the sub-scanning direction. In the example shown in FIG. 2, the nozzle rows 16A to 16C are formed of a first group on the upstream side T1 in the sub-scanning direction, and a second group further to the downstream side T2 in the sub-scanning direction than the first group. The number of nozzle holes 17 constituting one group is not particularly limited. The number of nozzle holes 17 constituting the group may be the same or different for each group.

As described above, a serial head type printer (a printing apparatus) is mainly described, but the invention is not limited to this type. Specifically, the printer may be a line head type printer in which printing heads are fixed and sequentially arranged in the sub-scanning direction, and a lateral type printer provided with a head (a carriage) provided with a later mechanism moving in an X direction and a Y direction (the main scanning direction and the sub-scanning direction) disclosed in JP-A-2002-225255. For example, SuperPressL-4033A (manufactured by Seiko Epson Corporation) is a lateral type printer. In the invention, a printing apparatus in which nozzle rows of a serial head are divided to print an image to be described later, or a lateral type printing apparatus is preferable, since an image of a white-based ink ejected in advance is satisfactorily formed and then it is possible to satisfactorily form a color image.

1.2. Image Printing Mode

The ink jet printing apparatus according to the embodiment performs a plurality of modes on the basis of a command from a control unit. In the invention, a mode means that a desired image is printed on a printing medium using an ink jet printing apparatus. In the invention, an "image" represents a printing pattern formed of dot groups, and also includes text printing, and solid printing.

1.2.1. First Embodiment

In the first embodiment, a first image printing mode and a second image printing mode are performed to print a predetermined image on a printing medium. In the invention, a clear image is an image formed by resin ink.

Figure 3A:
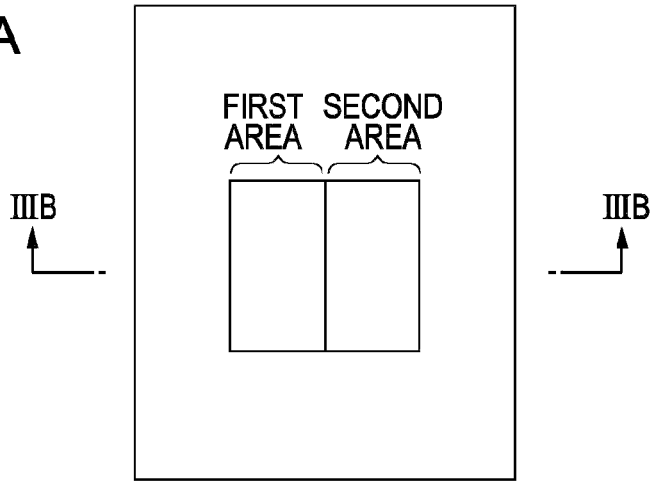
FIG. 3A and FIG. 3B are diagrams schematically illustrating a printing medium on which a white image is printed by a first image printing mode.
Figure 3B:
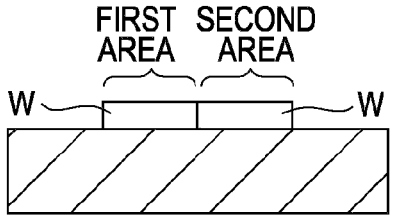

FIG. 3A and FIG. 3B are diagrams schematically illustrating a printing medium on which a white image is printed by the first image printing mode. Specifically, FIG. 3A is a diagram illustrating an upper face of a printing medium P on which a white image (W) formed of a white-based ink composition is printed in the first area and the second area by the first image printing mode. FIG. 3B is a diagram illustrating a cross section of IIIB-IIIB of FIG. 3A.

Figure 4A:
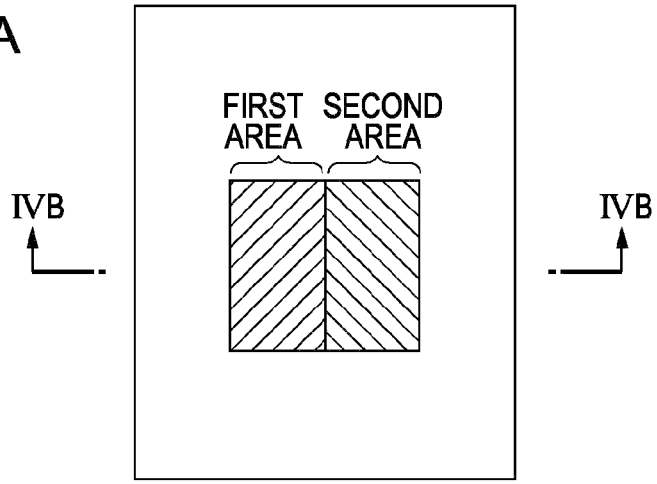
FIG. 4A and FIG. 4B are diagrams schematically illustrating a printing medium on which a color image and a clear image are printed by a second image printing mode.
Figure 4B:
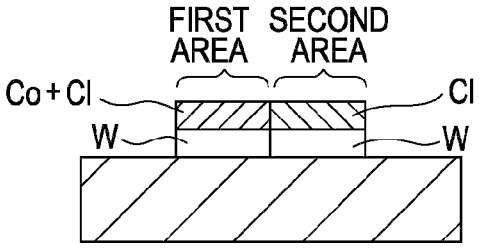

FIG. 4A and FIG. 4B are diagram schematically illustrating a printing medium on which a color image and a clear image are printed by the second printing mode. Specifically, FIG. 4A is a diagram illustrating a surface of the printing medium P on which a color image (Co+Cl: Co+Cl is an image in which color ink and resin ink are mixed) formed of a color ink composition and a resin ink composition is printed in the first area by the second image printing mode, and a clear image (Cl) formed of a resin ink composition is printed in the second area. FIG. 4B is a diagram illustrating a cross section of IVB-IVB of FIG. 4A.

As shown in FIG. 3A to FIG. 4B, according to the first embodiment, in the first area of the printing medium P, the white image (W) formed of the white-based ink composition and the color image (Co+Cl) formed of the color ink composition and the resin ink composition on the white image (W) are printed. In the second area different from the first area of the printing medium P, the white image (W) formed of the white-based ink composition and the clear image (Cl) formed of the resin ink composition on the white image (W) are printed.

Hereinafter, the modes will be described in detail. In the invention, there is a case where the white-based ink composition is briefly referred to as "white-based ink", the color ink composition is briefly referred to as "color ink", and the resin ink composition is briefly referred to as "resin ink".

1. First Image Printing Mode

The first image printing mode is a mode of ejecting the white-based ink to be described later from the nozzle holes to adhere the white-based ink to the first area and the second area of the printing medium to print an image.

Using the printer 1 shown in FIG. 1, the first image printing mode is performed as follows. First, the liquid droplets of the white-based ink is ejected (only the white-based ink is ejected, or the white ink is ejected without being substantially concurrently ejected with the resin ink) from the nozzle holes 17 of the nozzle row 16A while moving the carriage 4 in the main scanning direction, to adhere the liquid droplets to the first area and the second area of the printing medium P. In this case, the printing of the image to the first area and the printing of the image to the second area are performed at the time of the same scanning of the carriage 4.

Accordingly, the white image (W) formed of the white-based ink is printed in the first area and the second area of the printing medium P (FIG. 3A and FIG. 3B)

2. Second Image Printing Mode and Third Image Printing Mode

The second image printing mode is a mode of substantially concurrently ejecting the color ink and the resin ink from the nozzle holes to contact and adhere the color ink and the resin ink onto the white-based ink of the first area to print an image, and ejecting the resin ink from the nozzle holes to adhere the resin ink onto the white-based ink of the second area to print an image.

In the invention, the "substantially concurrently" means that liquid droplets of both inks of one ink and the other ink are ejected at the timing when they can be mixed with each other. In addition, it includes a case of ejecting the other ink in a state where one ink lands on the printing medium and flows. For example, when a general ink jet printer that ejects ink while scanning nozzles with respect to a printing medium is used, it means that one specific image is formed by both of one ink and the other ink in one scanning (hereinafter, also referred to as "one pass"). Accordingly, except for the case of completely concurrently ejecting both inks, a case of ejecting one ink in one pass and then ejecting the other ink is included in the "substantially concurrently".

When the printer 1 shown in FIG. 1 is used, the second image printing mode is performed as follows. Subsequently to the first image printing mode, the color ink is ejected from the nozzle holes 17 of the nozzle row 16B and the resin ink is ejected from the nozzle holes 17 of the nozzle row 16C while moving the carriage 4 in the main scanning direction.

Accordingly, on the white image printed in the first area, the color image (Co+Cl) formed of the color ink and the resin ink is printed. On the white image (W) printed in the second area, the clear image (Cl) formed of the resin ink is printed (that is, it is not substantially concurrently is ejected) (FIG. 4A and FIG. 4B).

In the second image printing mode, the printing of the image to the first area is performed by substantially concurrently ejecting the color ink and the resin ink and bringing the color ink and the resin ink in contact with the white image. Accordingly, as compared with the case of forming the color image using only the color ink and then forming the clear image using only the resin ink on the color image, it is possible to reduce the number of sheet passing times of the printing mode or to reduce the number of scanning times of the carriage. Accordingly, it is possible to raise a printing speed.

The printing of the color image (Co+Cl) to the first area, and the printing of the clear image (W) to the second area are performed at the time of the same scanning.

It is preferable to embody the first embodiment in which the first image printing mode and the second image printing mode are performed when the amount of resin included in the color ink adhered to the first area is less than 0.03 mg/in$^2$. In this case, it is preferable to perform the second image printing mode such that the sum (the total weight of resin included in the color image (Co+Cl) printed on the white image (W) of the first area) of the amount of resin included in the color image adhered to the first area and the amount of resin included in the resin ink adhered to the first area is equal to or more than 0.03 mg/in$^2$, more preferably equal to or more than 0.1 mg/in$^2$, and even more preferably equal to or more than 0.2 mg/in$^2$. When the total weight of the resin included in the color image (Co+Cl) printed on the white image (W) of the first area is equal to or more than 0.03 mg/in$^2$, the abrasion resistance of the printed image is further improved.

The total weight of the resin included in the color image (Co+Cl) printed on the white image (W) of the first area is not particularly limited, but may be controlled by the control unit CONT. As a preferable example, the control unit CONT calculates the amount of the resin included in the color ink adhered to the first area on the basis of the image information acquired in advance. Then, the amount of the resin included in the resin ink adhered to the second area is calculated on the basis of the calculated amount of the resin of the color ink. The control unit CONT determines the amount of ejected resin ink or a duty value on the basis of the calculated value. As described above, it is possible to adjust the total weight of the resin included in the image printed on the white image of the first area to a predetermined value.

The amount of the resin included in the ink adhered to the first area may be calculated on the basis of the amount of resin included in ink, the amount of ejected ink, and a duty value of ink.

In the specification, the "duty value" is a value calculated in the following formula.

$$\text{duty (\%)} = \text{number of actually ejected dots}/(\text{vertical resolution} \times \text{horizontal resolution}) \times 100$$

(in the formula, the "number of actually ejected dots" is the number of actually ejected dots per unit area, and each of the "vertical resolution" and the "horizontal resolution" is resolution per unit area.)

The amount (the total weight of the resin included in the clear image (Cl) printed on the white image (W) of the second area) of the resin included in the resin ink printed on the white image of the second area is preferably equal to or more than 0.03 mg/in$^2$, more preferably 0.1 mg/in$^2$, and even more preferably equal to or more than 0.2 mg/in$^2$. When the total weight of the resin included in the clear image (Cl) is equal to or more than 0.03 mg/in$^2$, it is possible to sufficiently protect the white image (W) printed on the second area, and it is possible to further improve the abrasion resistance of the white image.

The total weight of the resin included in the clear image (Cl) printed on the white image (W) of the second area is controlled by the control unit CONT. Specifically, the control unit CONT determines the amount of ejected resin ink and the duty value on the basis of the amount of the resin included in the white image (W).

3. Division of Nozzle Rows

In the image printing mode, a mode of dividing the nozzle rows into groups including a predetermined number of nozzle holes may be preferably used.

In the image printing method of divided use of the nozzle rows, a case of performing the first image printing mode and the second image printing mode will be described as an example.

Figure 5A:
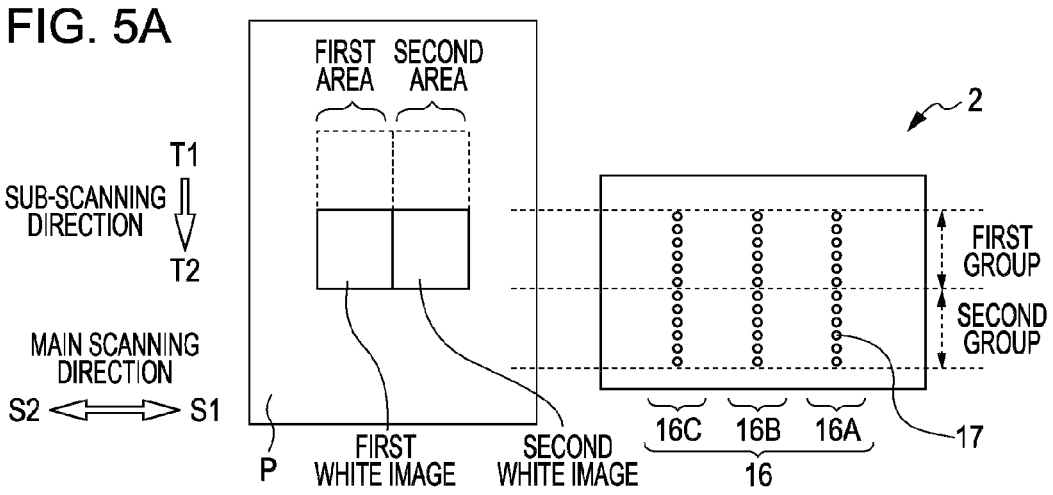
FIG. 5A to FIG. 5C are diagrams illustrating an image printing method when nozzle rows are divisionally used in the first embodiment.
Figure 5B:
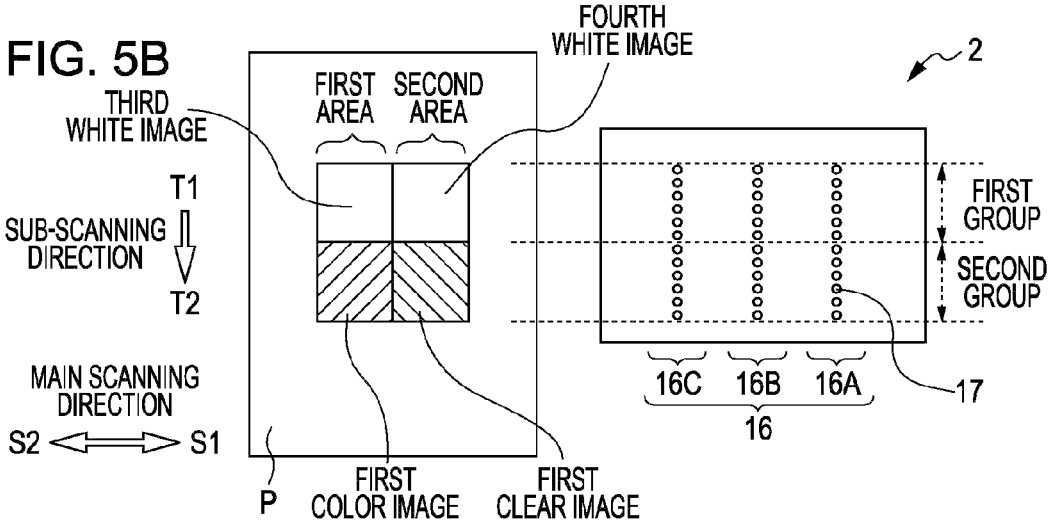
Figure 5C:
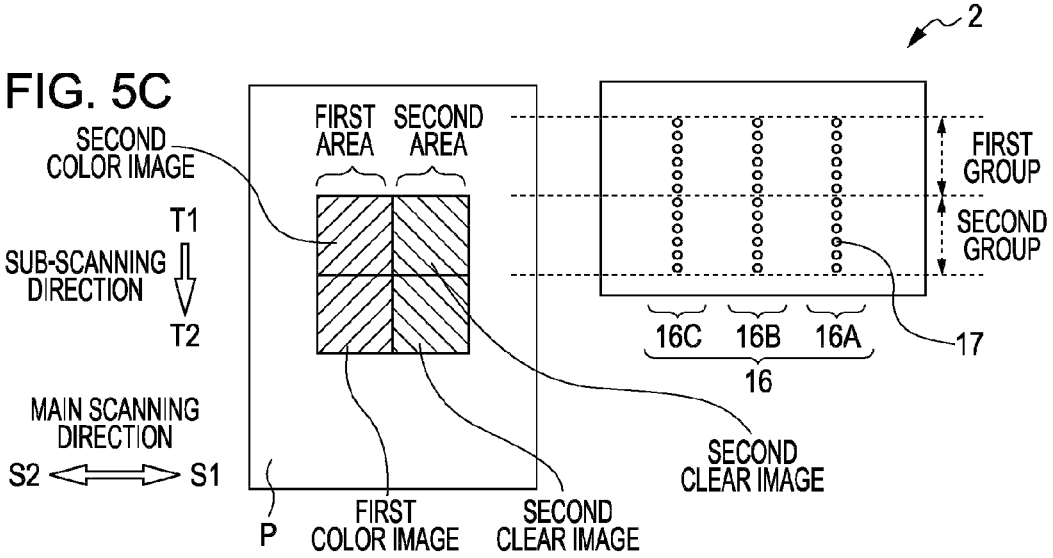

FIG. 5A to FIG. 5C are diagrams illustrating an image printing method when the nozzle rows are divisionally used. First, in the first image printing mode, liquid droplets of the white-based ink are ejected from the first group of the first nozzle row 16A. Accordingly, the first white image having a length of the first group is printed at a part of the first area of the printing medium P in the sub-scanning direction, and the second white image having a length of the first group is printed at a part of the second area of the printing medium P in the sub-scanning direction (FIG. 5A).

Then, the printing medium P is moved by the length of the first group in the sub-scanning direction, in the sub-scanning direction on the downstream side T2. In the second image printing mode, the color ink is ejected from the second group of the second nozzle row 16B, and the resin in ink is ejected from the second group of the third nozzle row 16C. Accordingly, the first color image formed of the color ink and the resin ink is printed on the first white image, and the first clear image formed of the resin ink is printed on the second white image (FIG. 5B).

At the scanning time of the carriage of the second image printing mode, the first image printing mode is performed again. In this case, the liquid droplets of the white-based ink are ejected from the first group of the first nozzle row 16A. Accordingly, in the first area (the upstream side of the first area in the sub-scanning direction) where the first white image is not printed, the third white image is printed. In the second area (the upstream side of the second area in the sub-scanning direction) where the second white image is not printed, the fourth white image is printed (FIG. 5B).

Then, the printing medium P is moved by the length of the second group in the sub-scanning direction, in the sub-scanning direction on the downstream side T2. In the second image printing mode, the color ink is ejected from the second group of the second nozzle row 16B, and the resin ink is ejected from the second group of the third nozzle row 16C. Accordingly, the second color image formed of the color ink and the resin ink is printed on the third white image, and the second clear image formed of the resin ink is printed on the fourth white image (FIG. 5C).

As described above, even when the nozzle rows are divisionally used, it is possible to perform the printing of the image in the first embodiment. By dividing the nozzle rows, it is possible to perform the printing at a high speed. When the printing medium is fed back, possibility that deviation in printing position may occur is high, and thus it is effective in that the feedback is not performed or the number thereof can be reduced.

According to the first embodiment, two modes of the first image printing mode and the second image printing mode are performed, and thus it is possible to print the image having excellent abrasion resistance. Therefore, in the first embodiment, it is possible to perform the printing of the image at high speed as compared with the case of performing three modes of printing the white image, printing the color image, and printing the clear image.

4. Others

In the first embodiment, the amount of the resin in the color ink adhered to the first area is equal to or more than 0.03 $mg/in^2$, the third image printing mode may be performed instead of the second image printing mode.

The third image printing mode is the same as the second image printing mode, except that only the color ink is ejected onto the white image of the first area or the color ink and the resin ink are not substantially concurrently ejected, and the color image formed of only the color ink is printed on the white image of the first area.

Specifically, the third image printing mode is a mode of ejecting the color ink from the nozzle holes to adhere the color ink onto the white image of the first area to print an image, and ejecting the resin ink from the nozzle holes to adhere the resin ink onto the white image of the second area to printer a clear image.

The switching from the second image printing mode to the third image printing mode is performed on the basis of the value calculated by the control unit CONT. In this case, it is preferable that the control unit CONT calculates the amount of the resin in the color ink adhered to the first area on the basis of the image information acquired in advance, and the switching of the mode is performed on the basis of the calculated value.

The amount of the resin in the color ink adhered to the first area may be calculated on the basis of the amount of resin contained in the color ink, the amount of ejected color ink, and the duty value of the color ink.

In the first embodiment, when the third image printing mode is provided, the resin ink may not be used according to the printed color image. For this reason, it is possible to reduce the amount of consumed resin ink.

1.2.2. Second Embodiment

In the second embodiment, the fourth image printing mode and the fifth image printing mode are performed to print a predetermined image on the printing medium.

Figure 6A:
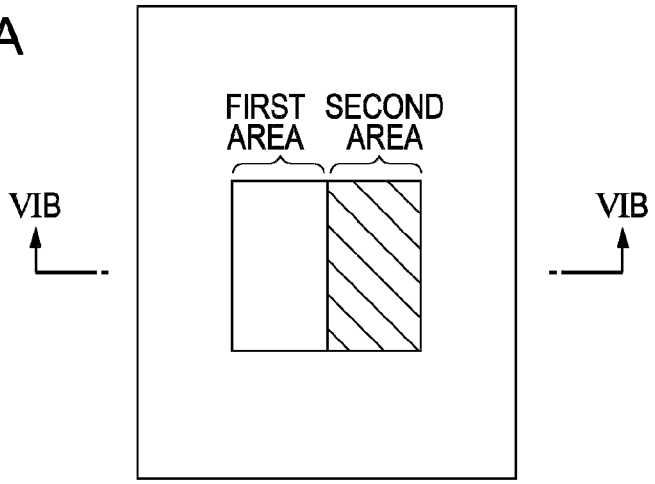
FIG. 6A and FIG. 6B are diagrams schematically illustrating a printing medium on which a white image is printed by a fourth image printing mode.
Figure 6B:
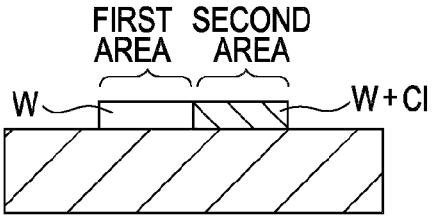

FIG. 6A and FIG. 6B are diagrams schematically illustrating a printing medium on which a white image is printed by the fourth image printing mode. Specifically, FIG. 6A is a diagram illustrating a surface of the printing medium P on which the white image (W) formed of the white-based ink is printed in the first area and the and the white image (W+Cl) formed of the white-based ink and the resin ink is printed in the second area, by the fourth image printing mode. FIG. 6B is a diagram illustrating a cross section of VIB-VIB of FIG. 6A.

Figure 7A:
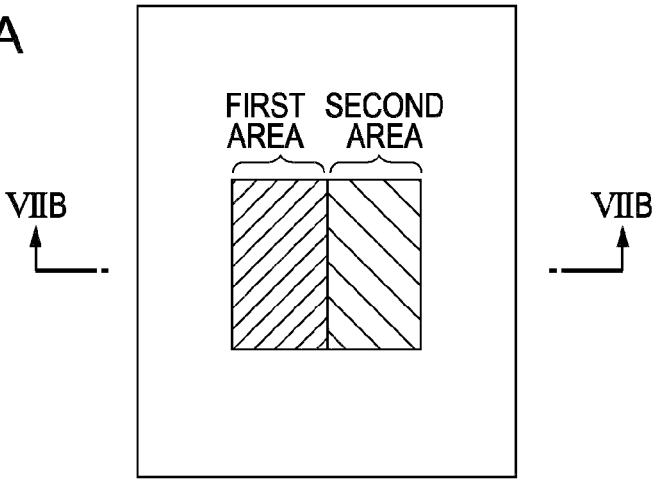
FIG. 7A and FIG. 7B are diagrams schematically illustrating a printing medium on which a color image is printed by a fifth image printing mode.
Figure 7B:
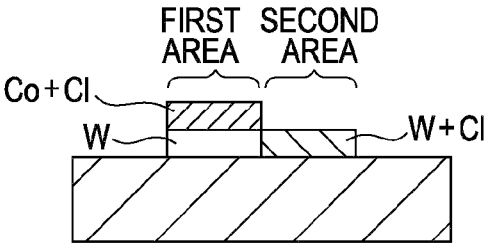

FIG. 7A and FIG. 7B are diagrams schematically illustrating a printing medium on which a color image is printed by the fifth image printing mode. Specifically, FIG. 7A is a diagram illustrating a surface of the printing medium P on which the color image (Co+Cl) formed of the color ink and the resin ink is printed in the first area by the fifth image printing mode. FIG. 7B is a diagram illustrating a cross section of VIIB-VIIB of FIG. 7A.

As shown in FIG. 6A to FIG. 7B, according to the second embodiment, in the first area of the printing medium P, the white image (W) (for example, the image which is not substantially concurrently ejected and is printed) formed of the white-based ink, and the color image (Co+Cl) formed of the color ink and the resin ink on the white image (W) are printed. In the second area different from the first area of the printing medium P, the white image (W+Cl) formed of the white-based ink and the resin ink is printed.

Hereinafter, the modes will be described in detail.

1. Fourth Image Printing Mode

The fourth image printing mode is a mode of ejecting the white-based ink from the nozzle holes to adhere the white-based ink to the first area of the printing medium to print an image, and substantially concurrently ejecting the white-based ink and the resin ink from the nozzle holes to contact and adhere the white-based ink composition and the resin ink composition to the second area of the printing medium different from the first area to print an image.

When the printer 1 shown in FIG. 1 is used, the fourth image printing mode is performed as follows. First, while moving the carriage 4 in the main scanning direction, the white-based ink is ejected from the nozzle holes 17 of the nozzle row 16A, and the resin ink is ejected from the nozzle holes 17 of the nozzle row 16C. Accordingly, on the first area, the white image (W) formed of the white-based ink is printed. On the second area, the white image (W+Cl) formed of the white-based ink and the resin ink is printed (FIG. 6A and FIG. 6B).

In the fourth image printing mode, the printing of the image to the second area is performed by substantially and concurrently ejecting the white-based ink and the resin ink to contact the white-based ink and the resin ink on the printing medium P. Accordingly, as compared with the case of forming the white image using only the white-based ink and then forming the clear image using only the resin ink on the white image, it is possible to reduce the number of sheet passing times of the printing medium or to reduce the number of scanning times of the carriage. Accordingly, it is possible to raise a printing speed.

The printing of the white image (W) to the first area, and the printing of the white image (W+Cl) to the second area are performed at the time of the same scanning.

The total amount of the resin included in the white-based ink and the resin ink ejected to the second area is preferably 0.03 mg/in$^2$, and more preferably equal to or more than 0.06 mg/in$^2$. When the amount of the resin of the clear image (Cl) included in the white image (W+Cl) is 0.03 mg/in$^2$, it is possible to further improve the abrasion resistance of the white image (W+Cl).

2. Fifth Image Printing Mode

The fifth image printing mode is a mode of substantially concurrently ejecting the color ink composition and the resin ink composition from the nozzle holes to contact and adhere the color ink composition and the resin ink composition onto the white-based ink composition of the first area to print an image.

When the printer 1 shown in FIG. 1 is used, the fifth image printing mode is performed as follows. Subsequently to the fourth image printing mode, while moving the carriage 4 in the main scanning direction, the color ink is ejected from the nozzle holes 17 of the nozzle row 16B, and the resin ink is ejected from the nozzle holes 17 of the nozzle row 16C.

Accordingly, on the white image printed in the first area, the color image (Co+Cl) formed of the color ink and the resin ink is printed (FIG. 7A and FIG. 7B).

In the fifth image printing mode, the printing of the image to the first area is performed by substantially concurrently ejecting the color ink and the resin ink to contact the color ink and the resin ink onto the white image (W). Accordingly, as compared with the case of forming the color image using only the color ink and then forming the clear image using only the resin ink on the color image, it is possible to reduce the number of sheet passing times of the printing medium or to reduce the number of scanning times of the carriage. Accordingly, it is possible to raise a printing speed.

It is preferable that the second embodiment of performing the fourth image printing mode and the fifth image printing mode is performed, particularly, when the amount of the resin included in the color ink adhered to the first area is less than 0.03 mg/in$^2$, more preferably equal to or more than 0.1 mg/in$^2$, and even more preferably equal to or more than 0.2 mg/in$^2$. In this case, it is more preferable that the fifth image printing mode is performed such that the sum (the total weight of the resin included in the image printed on the white image of the first area) of the amount of the resin included in the color ink adhered to the first area and the amount of the resin included in the resin ink adhered to the first area is equal to or more than 0.03 mg/in$^2$. The total weight of the resin included in the image printed on the white image of the first area is equal to or more than 0.03 mg/in$^2$, the abrasion resistance of the printed image may be further satisfactory.

The adjustment of the total weight of the resin included in the image printed on the white image of the first area is the same as the first embodiment, and the description thereof is not repeated.

3. Division of Nozzles

In the image printing mode described above, the nozzle rows may be divided into groups including a predetermined number of nozzle holes for each group.

In the image printing method of divided use of the nozzle rows, the case of performing the fourth image printing mode and the fifth printing mode will be described with an example.

Figure 8A:
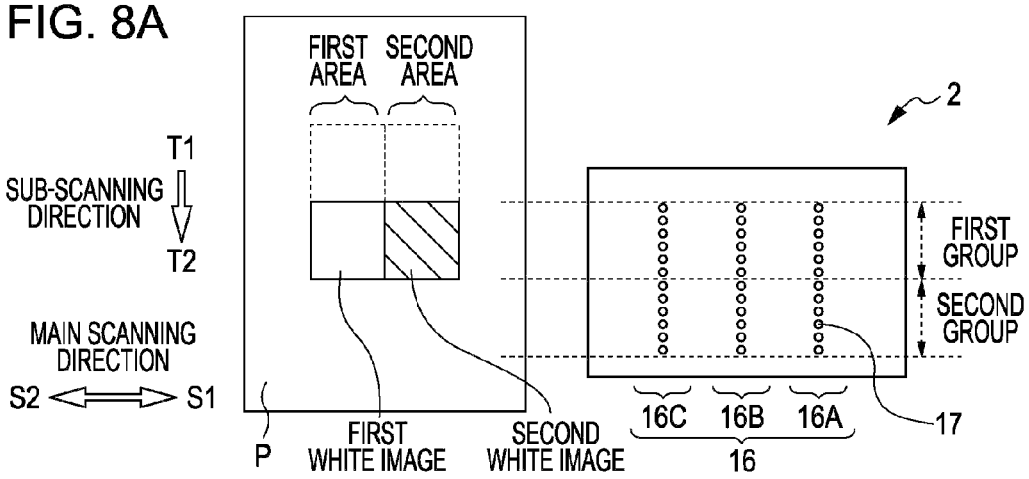
FIG. 8A to FIG. 8C are diagrams illustrating an image printing method when nozzle rows are divisionally used in the second embodiment.
Figure 8B:
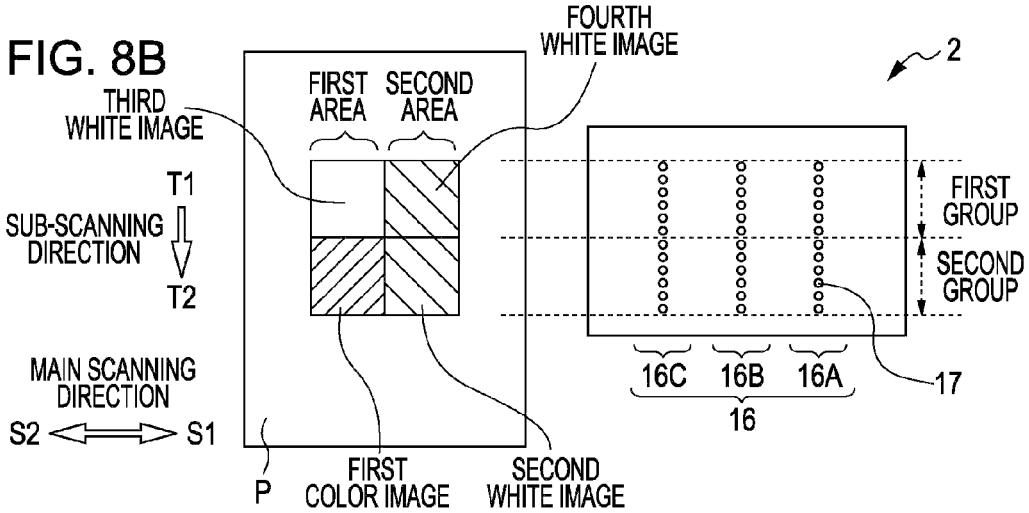
Figure 8C:
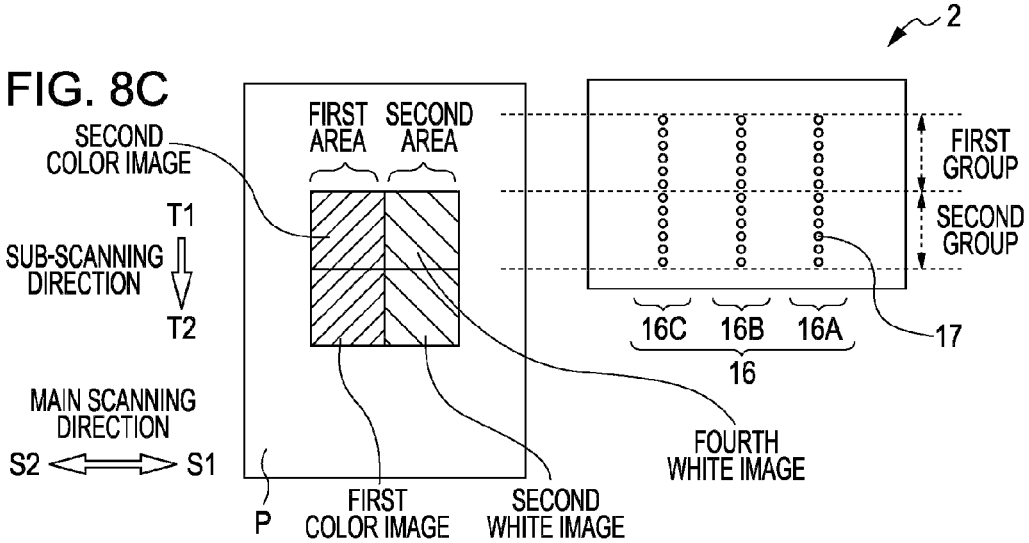

FIG. 8A to FIG. 8C are diagrams illustrating an image printing method when the nozzle rows are divisionally used. In the fourth image printing mode, the white-based ink is ejected from the first group of the first nozzle row 16A, and the resin ink composition is ejected from the first group of the third nozzle row 16C. Accordingly, the first white image (W) having a length of the first group is printed at a part of the first area of the printing medium P in the sub-scanning direction, and the second white image (W+Cl) having a length of the first group is printed at a part of the second area of the printing medium P in the sub-scanning direction (FIG. 8A).

Then, the printing medium P is moved by the length of the first group in the sub-scanning direction, in the sub-scanning direction on the downstream side T2. In the fifth image printing mode, the color ink is ejected from the second group of the second nozzle row 16B, and the resin in ink is ejected from the second group of the third nozzle row 16C. Accordingly, the first color image (Co+Cl) formed of the color ink and the resin ink is printed on the first white image (W) (FIG. 8B).

At the scanning time of the carriage of the fifth image printing mode, the fourth image printing mode is performed again. In this case, the white-based ink is ejected from the first group of the first nozzle row 16A, and the resin ink is ejected from the first group of the third nozzle row 16C. Accordingly, in the first area (the upstream side of the first area in the sub-scanning direction) where the first white image (W) is not printed, the third white image (W) is printed. In the second area (the upstream side of the second area in the sub-scanning direction) where the second white image (W+Cl) is not printed, the fourth white image (W+Cl) is printed (FIG. 8B).

Then, the printing medium P is moved by the length of the second group in the sub-scanning direction, in the sub-scanning direction on the downstream side T2. In the fifth image printing mode, the color ink is ejected from the second group of the second nozzle row 16B, and the resin ink is ejected from the second group of the third nozzle row 16C. Accordingly, the second color image (Co+Cl) formed of the color ink and the resin ink is printed on the third white image (FIG. 8C).

As described above, even when the nozzle rows are divisionally used, it is possible to perform the printing of the image in the second embodiment.

According to the second embodiment, two modes of the fourth image printing mode and the fifth image printing mode are performed, and thus it is possible to print the image having excellent abrasion resistance. Therefore, in the second embodiment, it is possible to perform the printing of the image at high speed as compared with the case of performing three modes of printing the white image, printing the color image, and printing the clear image.

It is preferable to embody the second embodiment, particularly when the amount of the resin included in the color ink adhered to the first area is less than 0.03 mg/in$^2$.

4. Others

In the second embodiment, the amount of the resin in the color ink adhered to the first area is equal to or more than 0.03 mg/in$^2$, the sixth image printing mode may be performed instead of the fifth image printing mode.

The sixth image printing mode is the same as the fifth image printing mode, except that only the color ink is ejected onto the white image of the first area and the color image formed of only the color ink is printed on the white image of the first area.

Specifically, the sixth image printing mode is a mode of ejecting the color ink from the nozzle holes to adhere the color ink onto the white-based ink of the first area to print an image.

The switching from the fifth image printing mode to the sixth image printing mode may be performed in the same as the switching from the second image printing mode to the third image printing mode, and the description thereof is not repeated.

In the second embodiment, when the sixth image printing mode is provided, the resin ink may not be used according to the printed color image. For this reason, it is possible to reduce the amount of consumed resin ink.

1.2.3. Third Embodiment

The third embodiment is a mode of performing the seventh image printing mode and the eighth image printing mode to print a predetermined image on the printing medium.

Figure 9A:
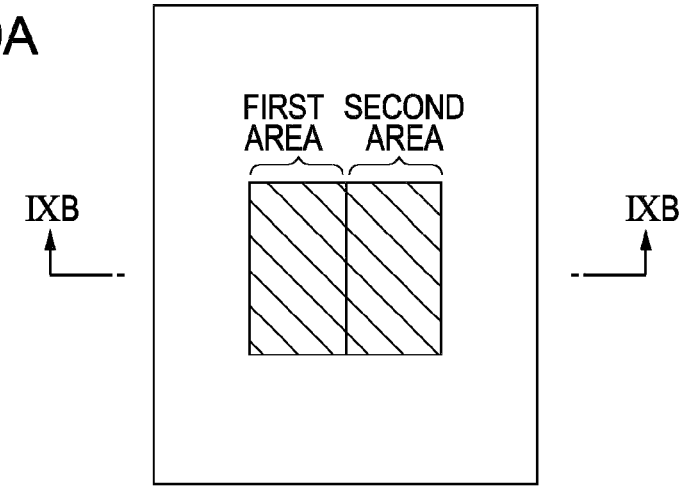
FIG. 9A and FIG. 9B are diagrams schematically illustrating a printing medium on which a white image is printed by a seventh image printing mode.
Figure 9B:
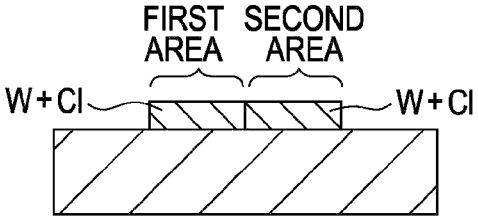

FIG. 9 is a diagram schematically illustrating a printing medium on which a white image is printed by the seventh image printing mode. Specifically, FIG. 9A is a diagram illustrating a surface of the printing medium P on which the white image (W+Cl) formed of the white-based ink and the resin ink is printed in the first area and the white image (W+Cl) formed of the white-based ink and the resin ink is printed in the second area, by the seventh image printing mode. FIG. 9B is a diagram illustrating a cross section of IXB-IXB of FIG. 9A.

Figure 10A:
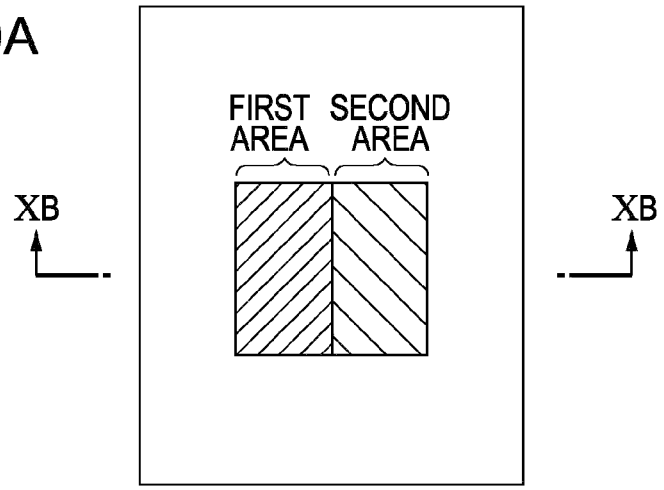
FIG. 10A and FIG. 10B are diagrams schematically illustrating a printing medium on which a color image is printed by the eighth image printing mode.
Figure 10B:
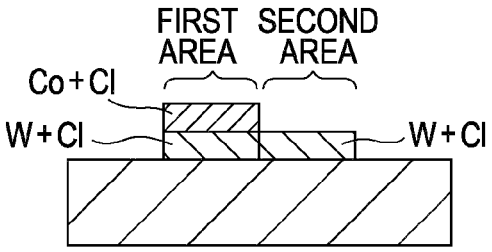

FIG. 10A and FIG. 10B are diagrams schematically illustrating a printing medium on which a color image is printed by the eighth image printing mode. Specifically, FIG. 10A is a diagram illustrating a surface of the printing medium P on which the color image (Co+Cl) formed of the color ink and the resin ink is printed in the first area by the eighth image printing mode. FIG. 10B is a diagram illustrating a cross section of XB-XB of FIG. 10A.

As shown in FIG. 9A to FIG. 10B, according to the third embodiment, the white image (W+Cl) formed of the white-based ink and the resin ink and the color image (Co+Cl) formed of the color ink and the resin ink are printed in the first area of the printing medium P. In the second area different from the first area of the printing medium P, the white image (W+Cl) formed of the white-based ink and the resin ink is printed.

Hereinafter, the modes will be described in detail.

1. Seventh Image Printing Mode

The seventh image printing mode is a mode of substantially concurrently ejecting the white-based ink and the resin ink from the nozzle holes to contact and adhere the white-based ink and the resin ink to the first area of the printing medium and the second area of the printing medium different from the first area to print an image.

When the printer 1 shown in FIG. 1 is used, the seventh image printing mode is performed as follows. First, while moving the carriage 4 in the main scanning direction, the white-based ink is ejected from the nozzle holes 17 of the nozzle row 16A, and the resin ink is ejected from the nozzle holes 17 of the nozzle row 16C. Accordingly, on the first area and the second area, the white image (W+Cl) formed of the white-based ink and the resin ink is printed (FIG. 9A and FIG. 9B).

In the seventh image printing mode, the printing of the image to the first area and the second area is performed by substantially and concurrently ejecting the white-based ink and the resin ink to contact the white-based ink and the resin ink on the printing medium P. Accordingly, as compared with the case of forming the white image using only the white-based ink and then forming the clear image using only the resin ink on the white image, it is possible to reduce the number of sheet passing times of the printing medium or to reduce the number of scanning times of the carriage. For this reason, it is possible to raise a printing speed.

The total amount of the resin included in the white-based ink and the resin ink ejected to the second area is preferably 0.03 mg/in$^2$, and more preferably equal to or more than 0.06 mg/in$^2$. When the amount of the resin included in the white image (W+Cl) is 0.03 mg/in$^2$, it is possible to further improve the abrasion resistance of the white image (W+Cl).

2. Eighth Image Printing Mode

The eighth image printing mode is a mode of substantially concurrently ejecting the color ink composition and the resin ink composition from the nozzle holes to contact and adhere the color ink composition and the rein ink composition onto the white-based ink composition of the first area and the resin ink composition to print an image.

The eighth image printing mode is performed as follows when the printer 1 shown in FIG. 1 is used. Subsequently to the seventh image printing mode, the color ink is ejected from the nozzle holes 17 of the nozzle row 16B and the resin ink is ejected from the nozzle holes 17 of the nozzle row 16C while moving the carriage 4 in the main scanning direction.

Accordingly, on the white image (W+Cl) printed in the first area, the color image (Co+Cl) formed of the color ink and the resin ink is printed (FIG. 9A and FIG. 9B).

In the eighth image printing mode, the printing of the image to the first area is performed by substantially concurrently ejecting the color ink and the resin ink and bringing the color ink and the resin ink in contact with the white image (W+Cl). Accordingly, as compared with the case of forming the color image using only the color ink and then forming the clear image using only the resin ink on the color image, it is possible to reduce the number of sheet passing times of the printing medium or to reduce the number of scanning times of the carriage. Accordingly, it is possible to raise a printing speed.

It is preferable to embody the third embodiment in which the seventh image printing mode and the eighth image printing mode are performed when the amount of resin included in the color ink adhered to the first area is less than 0.03 mg/in$^2$. In this case, it is preferable to perform the eighth image printing mode such that the sum (the total weight of resin included in the color image (Co+Cl) printed on the white image (W+Cl) of the first area) of the amount of resin included in the color ink adhered to the first area and the amount of resin included in the resin ink adhered to the first area is equal to or more than 0.03 mg/in$^2$, more preferably equal to or more than 0.1 mg/in$^2$, and even more preferably equal to or more than 0.2 mg/in$^2$. When the total weight of the resin included in the color image (Co+Cl) printed on the white image (W) of the first area is equal to or more than 0.03 mg/in$^2$, the abrasion resistance of the printed image is further improved.

The adjustment of the total amount of the resin included in the image printed on the white image of the first area is performed in the same manner as the first embodiment, and the description thereof is not repeated.

3. Division of Nozzle

In the image printing mode described above, the nozzle rows may be divided into groups including a predetermined number of nozzle holes.

In the image printing method of divided use of the nozzle rows, the case of performing the seventh image printing mode and the eighth printing mode will be described as an example.

Figure 11A:
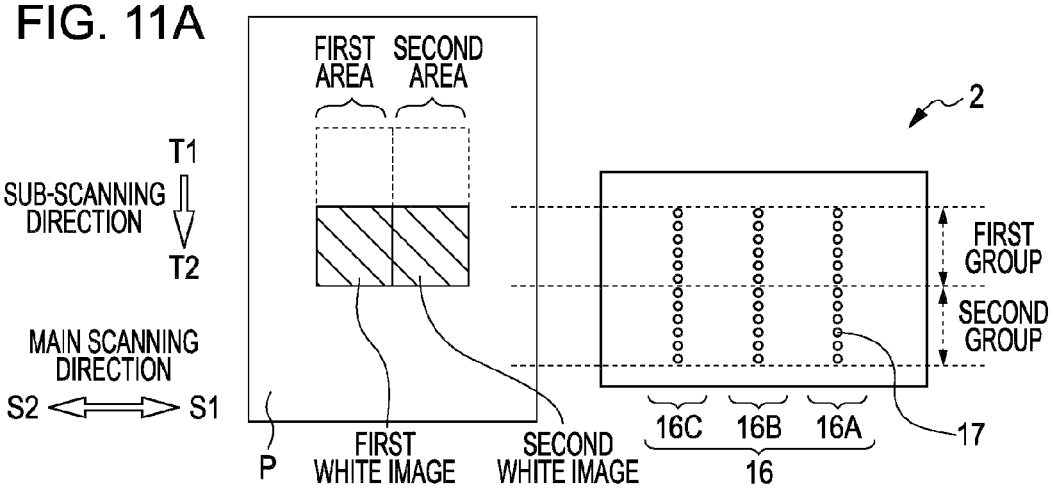
FIG. 11A to FIG. 11C are diagram illustrating an image printing method when nozzle rows are divisionally used in the third embodiment.
Figure 11B:
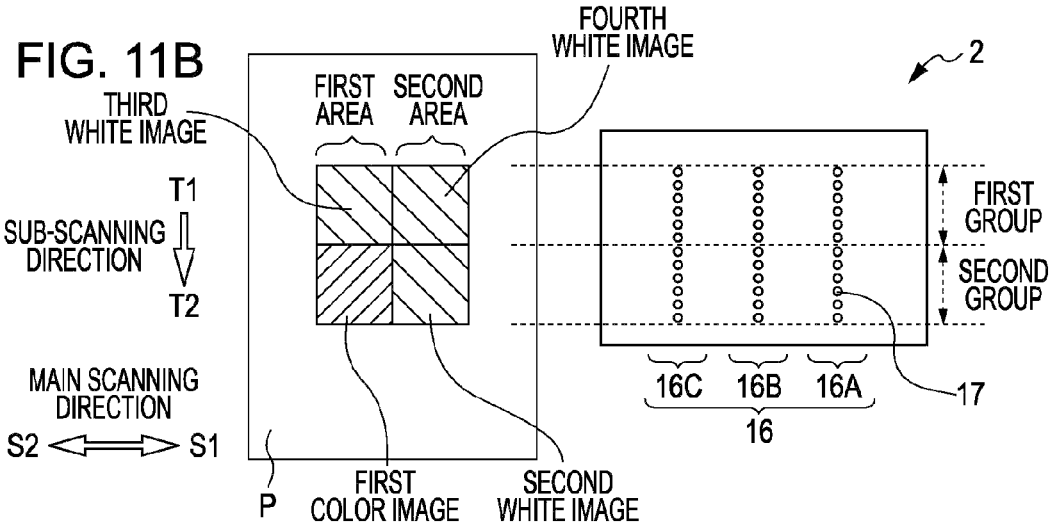
Figure 11C:
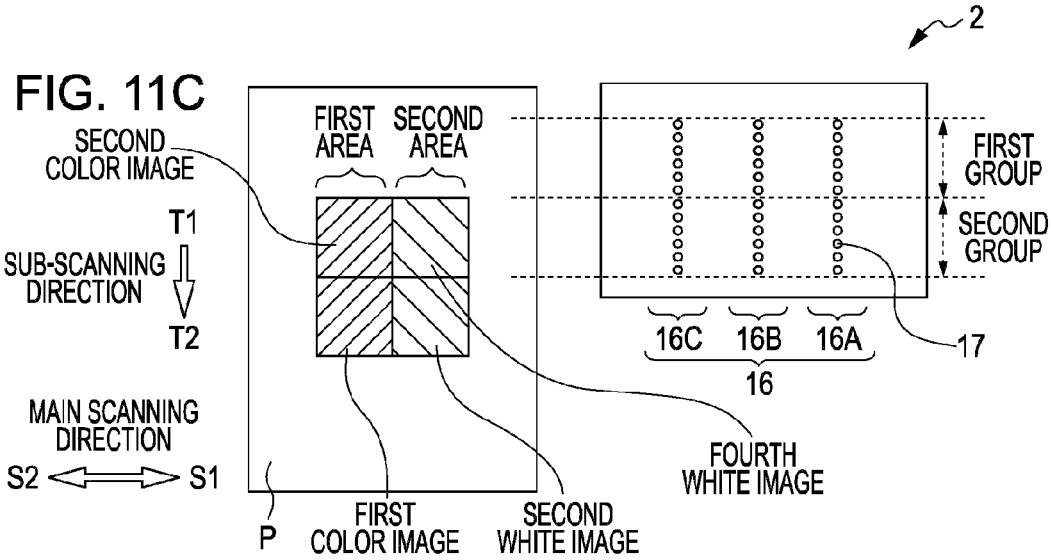

FIG. 11A to FIG. 11C are diagrams illustrating an image printing method when the nozzle rows are divisionally used. In the seventh image printing mode, the white-based ink is ejected from the first group of the first nozzle row 16A, and the resin ink is ejected from the first group of the third nozzle row 16C. Accordingly, the first white image (W+Cl) having a length of the first group is printed at a part of the first area of the printing medium P in the sub-scanning direction, and the second white image (W+Cl) having a length of the first group is printed at a part of the second area of the printing medium P in the sub-scanning direction (FIG. 11A).

Then, the printing medium P is moved by the length of the first group in the sub-scanning direction, in the sub-scanning direction on the downstream side T2. In the eighth image printing mode, the color ink is ejected from the second group of the second nozzle row 16B, and the resin ink is ejected from the second group of the third nozzle row 16C. Accordingly, the first color image (Co+Cl) formed of the color ink and the resin ink is printed on the first white image (W) (FIG. 11B).

At the scanning time of the carriage of the eighth image printing mode, the seventh image printing mode is performed again. In this case, the white-based ink is ejected from the first group of the first nozzle row 16A, and the resin ink is ejected from the first group of the third nozzle row 16C. Accordingly, in the first area (the upstream side of the first area in the sub-scanning direction) where the first white image (W+Cl) is not printed, the third white image (W+Cl) is printed. In the second area (the upstream side of the second area in the sub-scanning direction) where the second white image (W+Cl) is not printed, the fourth white image (W+Cl) is printed (FIG. 11B).

Then, the printing medium P is moved by the length of the second group in the sub-scanning direction, in the sub-scanning direction on the downstream side T2. In the eighth image printing mode, the color ink is ejected from the second group of the second nozzle row 16B, and the resin ink is ejected from the second group of the third nozzle row 16C. Accordingly, the second color image (Co+Cl) formed of the color ink and the resin ink is printed on the third white image (W+Cl) (FIG. 8C).

As described above, even when the nozzle rows are divisionally used, it is possible to perform the printing of the image in the third embodiment.

According to the third embodiment, two modes of the seventh image printing mode and the eighth image printing mode are performed, and thus it is possible to print the image having excellent abrasion resistance. Therefore, in the third embodiment, it is possible to perform the printing of the image at high speed as compared with the case of performing three modes of printing the white image, printing the color image, and printing the clear image.

4. Others

In the third embodiment, the amount of the resin in the color ink adhered to the first area is equal to or more than 0.03 mg/in$^2$, the ninth image printing mode may be performed instead of the eighth image printing mode.

The ninth image printing mode is the same as the eighth image printing mode, except that only the color ink is ejected onto the white image of the first area and the color image formed of only the color ink is printed on the white image of the first area.

Specifically, the ninth image printing mode is a mode of ejecting the color ink from the nozzle holes to adhere the color ink onto the white-based ink of the first area and the resin ink to print an image.

The switching from the eighth image printing mode to the ninth image printing mode may be performed in the same as the switching from the second image printing mode to the third image printing mode, and the description thereof is not repeated.

In the third embodiment, when the ninth image printing mode is provided, the resin ink may not be used according to the printed color image. For this reason, it is possible to reduce the amount of consumed resin ink.

1.3. Ink Composition

The ink compositions used in the ink jet printing apparatus according to the embodiment are formed of the white-based ink composition, the color ink composition, and the resin ink composition. Hereinafter, components included in each ink composition will be described.

1.3.1 White-Based Ink Composition

The "white-based ink" is ink capable of printing a color universally called "white", and includes that a small amount of white-based ink is colored. Ink containing a pigment thereof includes ink called and sold a name of "white color ink and white ink". For example, when ink is printed on EPSON pure photography sheet (glossy) (manufactured by Seiko Epson Corporation) with a 100% duty or more with an amount of sufficiently coating the surface of the photography sheet, and when brightness (L*) and chromaticity (a*, b*) of ink is measured when a measurement condition is a D50 light source, an observation field of view is 2°, a concentration is DIN NB, a white standard is Abs, a filter is No, and a measurement mode is Reflectance, using a spectrophotometer Spectrolino (product name, manufactured by GretagMacbeth, Co., Ltd.), the ink includes ink representing ranges of $70 \leq L^* \leq 100$, $-4.5 \leq a^* \leq 2$, and $-6 \leq b^* \leq 2.5$.

The white-based ink of the embodiment may be used to print an image on a printing medium (for example, plastic or metal) which is not white. In such a case, the white-based ink is used to form a foundation layer, to clear off the color of the printing medium or to decrease transparency of the color image.

Next, components included in the white-based ink will be described in detail.

1. White-Based Color Material

The white-based ink according to the embodiment contains a white-based color material. The white-based color material may be, for example, metal oxide, barium sulfate, and calcium carbonate. The metal oxide may be, for example, titanium dioxide, zinc oxide, silica, alumina, and magnesium oxide. The white-based color material includes hollow structure particles, and the hollow structure particles are not particularly limited, and the known particles may be used. As the hollow structure particles, for example, particles disclosed in the specification of U.S. Pat. No. 4,880,465 may be preferably used. The white-based color material contained in the white-based ink of the embodiment is preferably titanium dioxide from the viewpoint of white degree and abrasion resistance, among them.

The content (solid) of the white-based color material is preferably equal to more than 1% and equal to or less than 20%, and more preferably equal to or more than 5% and equal to or less than 15%. When the content of the white-based color material is over the range, nozzle clogging or the like of the ink jet printing apparatus may occur. Meanwhile, when the content of the white-based color material is less than the range, color concentration such as a white degree may be insufficient.

An average particle diameter based on volume (hereinafter, referred to as "average particle diameter") of the white-based color material is preferably equal to or more than 30 nm and equal to or less than 600 nm, and more preferably, equal to or more than 200 nm and equal to or less than 400 nm. When the average particle diameter of the white-based color material is over the range, dispersion stability is damaged such that the particles is settled out, or loading of the nozzles may occur when it is applied to the ink jet printing apparatus. Meanwhile, when the average particle diameter of the white-based color material is less than the range, the white degree may be insufficient.

The average particle diameter of the white-based color material may be measured by a particle size distribution measuring device in which a laser refraction scattering method is a measurement principle. The particle size distribution measuring device may be, for example, a particle size distribution analyzer (for example, "micro-truck UPA" manufactured by Nikkiso Co., Ltd.) in which a dynamic light scattering method is a measurement principle.

2. Other Components

Resin

The white-based ink may contain resin. As one of functions of resin, the white-based ink is fixed onto the printing medium. The content of resin (solid amount) is preferably equal to or more than 1 mass % and equal to or less than 7 mass %, and more preferably equal to or more than 1 mass % and equal to or less than 5 mass % with respect to the total mass of the white-based ink. When the content of the resin included in the white-based ink falls within the range, it is possible to preferably prevent nozzle clogging of the white-based ink from occurring. When the content of the resin included in the white-based ink is not over the range, particularly, the upper limit, it may be possible to reduce occurrence of cracks of the white image or cracks of the color image formed on the white image.

The resin may be, for example, the known resin such as acrylic resin, styrene acrylic resin, fluorene-based resin, urethane resin, polyolefin resin, rosin-modified resin, terpene resin, polyester resin, polyamide resin, epoxy resin, vinyl chloride resin, vinyl chloride-acetic acid vinyl copolymer, and ethylene vinyl acetate resin, and polyolefin wax. Such resin may be used in combination of one or more kinds.

In the exemplified resins, styrene acrylic resin, polyester resin, and polyolefin wax may be preferably used.

As the polyester resin, a marketed product may be used, and for example, there may be Eastek 1100, 1300, and 1400 (product names, manufactured by Eastman Chemical, Japan Limited), ELITEL KA-5034, KA-3556, KA-1449, KT-8803, KA-5071S, KZA-14495, KT-8701, and KT9204 (product names, manufactured by Unitika Co., Ltd.).

The styrene acrylic resin may be, for example, styrene-acrylic acid copolymer, styrene-methacrylic acid copolymer, styrene-methacrylic acid-acrylic acid ester copolymer, styrene-α-Methyl styrene-acrylic acid copolymer, styrene-α-methyl styrene-acrylic acid-acrylic acid ester copolymer. The type of the copolymer may be any type of random copolymer, block copolymer, alternating copolymer, and a graft copolymer. As the styrene acrylic resin, a marketed product may be used. The marketed product of the styrene acrylic resin may be Joncryl 62J (BASF Japan Ltd.).

The polyolefin wax is not particularly limited, and may be, for example, wax olefins such as ethylene, propylene, and butylene, or derivative thereof, and copolymer thereof, specifically, polyethylene-based wax, polypropylene-based wax, and polybutylene-based wax. Among them, the polyethylene-based wax is preferable from the viewpoint of reducing occurrence of cracks of an image. The polyolefin wax may be used in combination of one or more kinds.

A marketed product of the polyolefin wax may be Chemipearl series such as "Chemipearl W4005" (manufactured by Mitsui Chemicals, Inc., polyethylene-based wax, diameter 200 to 800 nm, ring and ball method softening point 110° C., penetrometer method hardness 3, and solid 40%). In addition, it may be AQUACER series such as AQUACER 513 (polyethylene-based wax, diameter 100 to 200 nm, melting point 130° C., solid 30%), AQUACER 507, AQUACER 515, and AQUACER 840 (manufactured by BYK Japan KK), Hightech series such as Hightech E-7025P, Hightech E-2213, Hightech E-9460, Hightech E-9015, Hightech E-4A, Hightech E-5403P, and Hightech E-8237 (manufactured by Toho Chemical Industry Co., Ltd.), and Nopcoat PEM-17 (manufactured by San Nopco Limited, polyethylene emulsion, diameter 40 nm). They are marketed in an aqueous emulsion type in which polyolefin wax is dispersed in water by a normal method. In the white-based ink according to the embodiment, the polyolefin wax in the aqueous emulsion type may be directly added.

An average particle diameter of the polyolefin wax may be measured by a particle size distribution measuring device in which a laser refraction scattering method is a measurement principle. As the particle size distribution measuring device, for example, a particle size distribution analyzer ("micro-truck UPA" manufactured by Nikkiso Co., Ltd.) in which a dynamic light scattering method is a measurement principle.

Organic Solvent

The white-based ink may contain an organic solvent. A plurality of kinds of organic solvents may be contained in the white-based ink. The organic solvent used in the white-based ink may be 1,2-alkanediol, polyhydric alcohols, and pyrrolidone derivative.

The 1,2-alkanediol may be, for example, 1,2-propanediol, 1,2-butanediol, 1,2-pentanediol, 1,2-hexanediol, and 1,2-octanediol. The 1,2-alkanediol has a high wettability of ink to a printing medium and an excellent effect of uniformly wetting, and thus it is possible to form an excellent image on the printing medium. When the 1,2-alkanediol is contained, the content thereof is preferably equal to or more than 1 mass % and equal to or less than 20 mass % with respect to the total mass of the white ink.

Polyhydric alcohols may be, for example, ethylene glycol, diethylene glycol, propylene glycol, dipropylene glycol, 1,3-propanediol, 1,4-butanediol, 1,5-pentanediol, 1,6-hexanediol, and glycerin. When the white-based ink is used in the ink jet printing apparatus, the polyhydric alcohols may be preferably used from the viewpoint of suppressing drying solidification of the ink on the nozzle face of the head to reduce loading or ejection defect. When the polyhydric alcohols are contained, the content thereof is preferably equal to or more than 2 mass % and equal to or less than 20 mass % with respect to the total mass of the white-based ink.

The pyrrolidone derivative may be, for example, N-methyl-2-pyrrolidone, N-ethyl-2-pyrrolidone, N-vinyl-2-pyrrolidone, 2-pyrrolidone, N-butyl-2-pyrrolidone, and 5-methyl-2-pyrrolidone. The pyrrolidone derivative may act as a satisfactory dissolution agent of resin. When the pyrrolidone derivative is contained, the content thereof is preferably equal to or more than 0.1 mass % and equal to or less than 25 mass % with respect to the total mass of the white-based ink.

Surfactant

The white-based ink may contain a surfactant. The surfactant may be a silicon-based surfactant, and an acetylene glycol-based surfactant.

As the silicon-based surfactant, a polysiloxane compound is preferably used, and it may be, for example, polyether-modified organosiloxane. More specifically, it may be BYK-306, BYK-307, BYK-333, BYK-341, BYK-345, BYK-346, BYK-348 (product names, BYK Japan KK), KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (product names, Shin-Etsu Chemical Co., Ltd.). The silicon-based surfactant may be preferably used from the viewpoint of having an operation of uniformly widening such that shading and bleeding of the white-based ink does not occur on the printing medium. When the silicon-based surfactant is contained, the content thereof is preferably equal to or more than 0.1 mass % and equal to or less than 1.5 mass % with respect to the total mass of the white-based ink.

The acetylene glycol-based surfactant may be 2,4,7,9-tetramethyl-5-desine-4,7-diol, 3,6-dimethyl-4-octyne-3,6-diol, 3,5-dimethyl-1-hexyne-3-ol, and 2,4-dimethyl-5-hexyne-3-ol. A marketed acetylene glycol-based surfactant may be used, and for example, Surfynol 104, 104E, 104H, 104A, 104BC, 104DPM, 104PA, 104PG-50, 104S, 420, 440, 465, 485, SE, SE-F, 504, 61, DF37, DF110D, CT111, CT121, CT131, CT136, TG, and GA (product names, manufactured by Air Products and Chemicals. Inc.), Olfine B, Y, P, A, STG, SPC, E1004, E1010, PD-001, PD-002W, PD-003, PD-004, EXP.4001, EXP.4036, EXP.4051, AF-103, AF-104, AK-02, SK-14, and AE-3 (product names, manufactured by Nissin Chemical Industry Co., Ltd.), and Acetylenol E00, E00P, E40, and E100 (product names, manufactured by Kawaken Fine Chemicals Co., Ltd.). The acetylene surfactant has capability of appropriately keeping surface tension and interfacial tension, and has characteristics of little foaming property, as compared with the other surfactant. When the acetylene surfactant is contained, the content thereof is preferably equal to or more than 0.1 mass % and equal to or less than 1.0 mass % with respect to the total mass of the white-based ink.

Water

The white-based ink may be so-called aqueous ink containing water of 50% or more. The aqueous ink has low reactivity to a piezoelectric element included in a printing head and an organic binder included in a printing medium as compared with non-aqueous (solvent-based) ink (for example, see ink disclosed in the specification of U.S. Patent Application Publication No. 2007/0044684 as the ink used in prints), and thus there is a case where it is possible to reduce melting or corroding them. The aqueous ink may form an image with an excellent drying property as compared with the non-aqueous ink containing a lot of solvents with a high boiling point and a low viscosity. The aqueous ink in which an odor is also suppressed as compared with the solvent-based ink, and 50% or more of the composition thereof is water, and thus there is an advantage that it is preferable in environment.

Others

The white-based ink according to the embodiment may further contain a pH adjusting agent, a preservative and fungicide, a waterproof agent, and a chelator. When the white-based ink according to the embodiment contains such a compound, characteristics thereof may be further improved.

The pH adjusting agent may be, for example, potassium dihydrogen phosphate, disodium hydrogen phosphate, sodium hydroxide, lithium hydroxide, potassium hydroxide, ammonia, diethanolamine, triethanolamine, tri-isopropanol amine, potassium carbonate, sodium carbonate, and sodium hydrogen carbonate.

The preservative and fungicide may be, for example, sodium benzoate, pentachlorophenol sodium, 2-pyridine thiol-1-sodium oxide, sodium sorbate, sodium dehydroacetic acid, and 1,2-benzisothiazolin-3-on. The marketed product may be Proxel XL2, and Proxel GXL (product names, manufactured by Avecia or more), Denicide CSA, and NS-500W (product names, manufactured by Nagase chemteX Corporation).

The waterproof agent may be, for example, benzotriazole.

The chelator may be, for example, ethylenediaminetetraacetic acid and salts thereof (ethylenediamine tetraacetic acid dihydrogen disodium salt).

The white ink according to the embodiment may be prepared in the same manner as the pigment ink of the related art, for example, using a ball mill, a sand mill, an attritor, a basket mill, and a roll mill. In the preparation, it is preferable to remove coarse particles using a membrane filter or a mesh filter.

1.3.2. Color Ink Composition

The color ink composition according to the embodiment (hereinafter, referred to as "color ink") contains a color material (hereinafter, merely referred to as "color material") other than the white-based color material described above, and resin.

1. Color Material

The color material may be, for example, a dye and a pigment. The content of the color material is preferably equal to or more than 1 mass % and equal to or less than 20 mass %, and more preferably equal to or more than 1 mass % and equal to or less than 15 mass % with respect to the total mass of the color ink.

The dye and the pigment disclosed in the specification of U.S. Patent Application Publication No. 2010/0086690, the specification of U.S. Patent Application Publication No. 2005/0235870, and International Publication No. 2011/027842 may be appropriately used. Between the dye and the pigment, it is more preferable to include the pigment. The pigment is preferably an organic pigment from the viewpoint of reservation stability such as light resistance, weather resistance, and gas resistance.

Specifically, the pigment may be an azo pigment such as an insoluble azo pigment, a condensed azo pigment, azo lake, a chelate azo, polycyclic pigments such as a phthalocyanine pigment, a perylene and perinone pigment, an anthraquinone pigment, a quinacridone pigment, a dioxane pigment, a thioindigo pigment, an isoindolinone pigment, and a quinophthalone pigment, a chelate dye, a dye lake dye, a nitro pigment, a nitroso pigment, an aniline black, and a daylight fluorescent pigment. The pigments may be used in combination of one or more kinds.

The dye may be, for example, various kinds of dyes used in normal ink jet printing such as a direct dye, an acid dye, an edible dye, a basic dye, a reactive dye, a dispersion dye, a vat dye, a soluble vat dye, and a reactive dispersion dye.

2. Resin

The color ink includes resin. A function of the resin may be, for example, fixing the color ink onto the printing medium, or improving a dispersion property of the color material in the color ink.

The content of the resin is preferably equal to or more than 0.1 mass % and equal to or less than 10 mass %, and more preferably equal to or more than 1 mass % and equal to or less than 7 mass % with respect to the total mass of the color ink. When the content of the resin in the color ink falls within the range, the function of the resin is satisfactorily exhibited.

The resin included in the color ink may be the resin exemplified by the white-based ink described above.

3. Other Components

The color ink may contain components other than the components described above. The components usable in the color ink are the same as the components in "1.3.1. (2) Other Components", and the description thereof is not repeated.

1.3.3. Resin Ink Composition

The resin ink composition according to the embodiment (hereinafter, merely referred to as "resin ink") contains resin, and does not substantially contain a color material. The resin ink according to the embodiment does not substantially contain the color material, and thus is colorless transparent or colorless semitransparent liquid. The "does not substantially contain the color material" means that, for example, the content of the color material in the ink is less than 0.5 mass %, more preferably less than 0.1 mass %, and even more preferably less than 0.01 mass %, and most preferably less than 0.005 mass %.

The resin ink according to the embodiment is used mainly to improve abrasion resistance of the white image and the color image as described in the embodiments.

Hereinafter, components included in the resin ink will be described.

1. Resin

The resin ink contains resin. As one of functions of resin, the resin ink is fixed onto the printing medium.

The content of the resin is preferably equal to or more than 1 mass % and equal to or less than 15 mass %, and more preferably equal to or more than 5 mass % and equal to or less than 10 mass % with respect to the total mass of the resin ink. When the content of the resin in the resin ink falls within the range, the function of the resin is satisfactorily exhibited.

The resin included in the resin ink may be the resin exemplified in the description of the white-based ink described above.

2. Other Components

The resin ink may contain components other than the components described above. The components usable in the resin ink are the same as the components in "1.3.1. (2) Other Components", and the description thereof is not repeated.

1.3.4. Physicality of Ink

A viscosity of the white-based ink, the color ink, and the resin ink (hereinafter, merely referred to as "ink") at 20° C. is preferably equal to or more than 2 mPa·s and equal to or less than 10 mPa·s, and more preferably equal to or more than 3 mPa·s and equal to or less than 6 mPa·s. When the viscosity at 20° C. falls within the range, an appropriate amount of ink is ejected from the nozzles, it is possible to further reduce causing a flying curve or flying, and thus it is possible to appropriately use the ink in the ink jet printing apparatus. The viscosity of the ink may be measured by keeping the temperature of the ink at 20° C. using a vibration type viscometer VM-100AL (manufactured by Yamaichi Electronics Co., Ltd.).

2. Example

Hereinafter, the invention will be described in detail by examples, but the invention is not limited thereto.

2.1 Preparation of Ink

By a combination amount shown in Table 1 and Table 2, a color material, a resin component, 1,2-hexanediol, 2-pyrrolidone, propylene glycol, a surfactant, and ion-exchange water were mixed and stirred, the mixture was filtrated by a metal filter of a hole diameter of 5 μm and was subjected to a degassing process using a vacuum pump, white-based ink (W ink), color ink (Co ink), and resin ink (Cl ink) used in the following assessment were prepared.

In the preparation of the color ink, a pigment dispersion liquid in which a pigment (a color material) was dispersed in advance was used. The pigment dispersion liquid was prepared as follows. First, the inside of a separable flask of 2000 ml provided with a stirring device, a reflux tube, a temperature sensor, and a dropping lot was sufficiently nitrogen-substituted, and then a temperature was raised to 80° C. while putting and stirring diethylene glycol monomethyl ether of 200.0 parts by mass in the separable flask. Then, in the dropping lot, 200.0 parts by mass of diethylene glycol monomethyl ether, 483.0 parts by mass of cyclohexyl acrylate (hereinafter, referred to as "CHA"), 66.6 parts by mass of methacrylic acid (hereinafter, referred to as "MAA"), 50.4 parts by mass of acrylic acid (hereinafter, referred to as "AA"), and 4.8 parts by mass of t-butyl peroxy(2-ethyl hexanoate) (hereinafter, referred to as "BPEH") were put in, and were dropped in the separable flask at 80° C. for 4 hours. After the completion of the dropping, it was kept at 80° C. for 1 hour, and then 0.8 parts by mass of BPEH was added, and reaction was performed at 80° C. for 1 hour. After completing the aging, diethylene glycol monomethyl ether was removed by decompression and distillation. Thereafter, 600.0 parts by mass of methyl ethyl ketone (hereinafter, referred to as "MEK") was added, and a polymer composition solution for ink jet ink of resin solid of 50% was obtained. A part of the polymer composition solution for ink jet ink obtained as described above was taken, it was dried by a high thermal dryer of 105° C. for 1 hour, and an acid value of solid of the obtained ink jet ink polymer composition was 130 mgKOH/g, and a weight average molecular weight was 34,000. Then, 6.0 parts by mass of 30% aqueous sodium hydroxide were added to the 120.0 parts by mass of the polymer composition solution for the ink jet ink, the mixture was stirred for 5 minutes by a high speed disper, 480.0 parts by mass of a dispersion liquid including 15:3 of C.I. pigment blue of 25 mass % of pigment concentration is further added thereto, and the mixture was stirred for 1 hour by high speed disper, and a pigment dispersion liquid was obtained.

In the preparation of the white-based ink, a titanium dioxide dispersion liquid in which titanium dioxide (the color material) was dispersed in advance was used. The titanium dioxide dispersion liquid was prepared as follows. First, 25 parts by mass of a solid acrylic acid/n-butyl acrylate/benzyl methacrylate/styrene copolymer with a glass transition temperature of 40° C., a mass average molecular weight of 10,000, and an acid value of 150 mgKOH/g was dissolved in the mixed solution of 75 parts by mass of diethylene glycol diethyl ether, and a polymer dispersant solution of resin solid of 25 mass % was obtained. Then, 19 mass % of diethylene glycol diethyl ether was added to and mixed with 36 mass % of the polymer dispersant solution, resin varnish for titanium dioxide dispersion was prepared, 45 mass % of titanium dioxide (manufactured by C.I. Kasei Co., Ltd., product name "NanoTek® Slurry", slurry including titanium dioxide particles of an average particle diameter of 300 nm at a ratio of 15% of solid concentration) was further added, stirred, and mixed, then circulation wet mill grinding was performed, and a titanium dioxide dispersion liquid was obtained.

All the units of ink composition in Table 1 and Table 2 are mass %, and values for titanium dioxide pigment and resin are solid-converted values. As the components described in Table 1 and Table 2, specifically, the following were used.

Color Material titanium dioxide pigment (manufactured by C.I. Kasei Co., Ltd, product name "NanoTek® Slurry", slurry including titanium dioxide particles of an average particle diameter of 300 nm at a ratio of 15% of solid concentration)
cyan pigment (C.I. pigment blue 15:3)

Resin
polyester resin (manufactured by Unitika Co., Ltd., product name "KT-8803")
styrene acrylic resin (manufactured by BASF Japan Co., Ltd., product name "Joncryl 62J")
polyethylene wax (manufactured by BYK Japan KK, product name "AQUACER 513", average particle diameter 150 nm)

Other Components
surfactant (manufactured by BYK Japan KK, product name "BYK-348", a silicon-based surfactant)
1,2-hexanediol
2-pyrrolidone
propylene glycol
ion-exchange water

2.2. Ink Jet Printer

In the following assessment test, as the ink jet printing apparatus, a printer in which a sheet guide unit of an ink jet printer PX-G930 (product name, manufactured by Seiko Epson Corporation, nozzle resolution: 180 dpi) is provided for remodeling with a temperature variable heater was used.

Then, the white-based ink, the color ink, and the resin ink described in Table 1 and Table 2 were filled in ink cartridges only for the ink jet printer (manufactured by Seiko Epson Corporation, product name "PX-G930"), and the ink cartridges were mounted on the remodeled printer described above.

In the amount of ejected ink of the printer, the amount of ejected ink at duty of 100% was set to 15 mg/in$^2$.

2.3. Assessment Test

Samples for assessment test examples and comparative examples were produced, and printing conditions of an image were set as follows.

Condition a

The condition a is to perform the first embodiment described above.

Condition b

The condition b is the same as the first embodiment described above, except that the third image printing mode is performed instead of the second image printing mode of the first embodiment.

Condition c

The condition c is to perform the second embodiment described above.

Condition d

The condition d is the same as the second embodiment described above, except that the sixth printing mode is performed instead of the fifth image printing mode of the second embodiment.

Condition e

The condition e is to perform the third embodiment.

Condition f

The condition f is to perform the first image printing mode and then perform the sixth image printing mode. That is, in the condition f, any image is not printed on the white image printed in the second area.

Condition g

The condition g is to perform the first image printing mode, and then perform the sixth image printing mode to adhere the resin ink onto the image printed thereby in the first area and the second area to print a clear image.

2.3.1. Example 1

An assessment sample of Example 1 was produced by the condition a.

First Image Printing Mode

Specifically, first, the white-based ink was ejected to print the white image formed of the white-based ink in the first area and the second area of the printing medium. The printing of the image to the first area and the second area were performed at the time of the same carriage scan.

Second Image Printing Mode

The printing medium on which the white image obtained as described above was printed was transported to the printer again. The color ink and the resin ink were substantially concurrently ejected to print the color image formed of the color ink and the resin ink on the white image of the first area, and the resin ink was ejected to print the clear image formed of the resin ink on the white image of the second area. The printing of the color image to the first area and the printing of the clear image to the second area were performed at the time of the same carriage scan.

The image-printed printing medium was dried by the heater provided in the printer. The heater temperature of the printer was set to 45° C. The surface temperature of the printing medium in the vicinity of the printer head was measured during the printing of the image, and the surface temperature of the printing medium was substantially the same as the set temperature of the printer heater.

In such a manner, the assessment sample of Example 1 was obtained. In any image, a solid pattern was printed. The ejection condition of each ink is as follows.

White-based Ink: Resolution 1440×720 dpi, 100% duty
Color Ink: Resolution 1440×720 dpi, 10% duty
Resin ink: Resolution 1440×720 dpi, 20% duty As the printing medium, Lumirror (R) S10-100 μm (manufactured by Toray Industries, Inc., transparent PET film) was used.

2.3.2. Example 2

The assessment sample of Example 2 was produced by the condition b.

First Image Printing Mode

Specifically, first, the white-based ink was ejected to print the white image formed of the white-based ink in the first area and the second area of the printing medium. The printing of the image to the first area and the second area were performed at the time of the same carriage scan.

Third Image Printing Mode

The printing medium on which the white image obtained as described above was printed was transported to the printer again. The color ink and the resin ink were ejected at the time of the same carriage scan. Accordingly, the color image formed of the color ink was printed on the white image in the first area, and the clear image formed of the resin ink was printed on the white image of the second area.

The image-printed printing medium was dried by the heater provided in the printer. The heater temperature of the printer was set to 45° C. The surface temperature of the printing medium in the vicinity of the printer head was measured during the printing of the image, and the surface temperature of the printing medium was substantially the same as the set temperature of the printer heater.

In such a manner, the assessment sample of Example 2 was obtained. In any image, a solid pattern was printed. The ejection condition of each ink is as follows.

White-based Ink: Resolution 1440×720 dpi, 100% duty

Color Ink: Resolution 1440×720 dpi, 10% duty

Resin ink: Resolution 1440×720 dpi, 20% duty

As the printing medium, the same as that of Example 1 was used.

2.3.3. Example 3

The assessment sample of Example 3 was produced in the same manner as that of Example 2, except that the duty of the color ink was 50%. Accordingly, the assessment sample of Example 3 was obtained.

2.3.4. Example 4

The assessment sample of Example 4 was produced in the same manner as that of Example 2, except that the duty of the color ink was 60%. Accordingly, the assessment sample of Example 4 was obtained.

2.3.5. Example 5

The assessment sample of Example 5 was produced in the same manner as that of Example 2, except that the duty of the color ink was 100%. Accordingly, the assessment sample of Example 5 was obtained.

2.3.6 Example 6

The assessment sample of Example 6 was produced by the condition c.

Fourth Image Printing Mode

Specifically, first, the white-based ink was ejected to print the white image formed of the white-based ink on the first area of the printing medium, and the white-based ink and the resin ink was substantially concurrently ejected to print the white image formed of the white-based ink and the resin ink on the second area of the printing medium. The printing of the image to the first area and the second area were performed at the time of the same carriage scan.

Fifth Image Printing Mode

The printing medium on which the white image obtained as described above was printed was transported to the printer again. The color ink and the resin ink were substantially concurrently ejected to print the color image formed of color ink and the resin ink on the white image of the first area.

The image-printed printing medium was dried by the heater provided in the printer. The heater temperature of the printer was set to 45° C. The surface temperature of the printing medium in the vicinity of the printer head was measured during the printing of the image, and the surface temperature of the printing medium was substantially the same as the set temperature of the printer heater.

In such a manner, the assessment sample of Example 6 was obtained. In any image, a solid pattern was printed. The ejection condition of each ink is as follows.

White-based Ink: Resolution 1440×720 dpi, 100% duty

Color Ink: Resolution 1440×720 dpi, 10% duty

Resin ink: Resolution 1440×720 dpi, 20% duty

As the printing medium, the same as that of Example 1 was used.

2.3.7. Example 7

The assessment sample of Example 7 was produced by the condition d.

Fourth Image Printing Mode

Specifically, first, the white-based ink was ejected to print the white image formed of the white-based ink on the first area of the printing medium, and the white-based ink and the resin ink was substantially concurrently ejected to print the white image formed of the white-based ink and the resin ink on the second area of the printing medium. The printing of the image to the first area and the second area were performed at the time of the same carriage scan.

Sixth Image Printing Mode

The printing medium on which the white image obtained as described above was printed was transported to the printer again. The color ink was ejected to print the color image formed of the color ink on the white image of the first area.

The image-printed printing medium was dried by the heater provided in the printer. The heater temperature of the printer was set to 45° C. The surface temperature of the printing medium in the vicinity of the printer head was measured during the printing of the image, and the surface temperature of the printing medium was substantially the same as the set temperature of the printer heater.

In such a manner, the assessment sample of Example 7 was obtained. In any image, a solid pattern was printed. The ejection condition of each ink is as follows.

White-based Ink: Resolution 1440×720 dpi, 100% duty

Color Ink: Resolution 1440×720 dpi, 100% duty

Resin ink: Resolution 1440×720 dpi, 20% duty

As the printing medium, the same as that of Example 1 was used.

2.3.8. Example 8

The assessment sample of Example 8 was produced by the condition e.

Seventh Image Printing Mode

Specifically, first, the white-based ink and the resin ink were substantially concurrently ejected to print the white image formed of the white-based ink and the resin ink on the first area and the second area of the printing medium.

Eighth Image Printing Mode

The printing medium on which the white image obtained as described above was printed was transported to the printer again. The color ink and the resin ink were ejected to print the color image formed of the color ink and the resin ink on the white image of the first area.

The image-printed printing medium was dried by the heater provided in the printer. The heater temperature of the printer was set to 45° C. The surface temperature of the printing medium in the vicinity of the printer head was measured during the printing of the image, and the surface temperature of the printing medium was substantially the same as the set temperature of the printer heater.

In such a manner, the assessment sample of Example 8 was obtained. In any image, a solid pattern was printed. The ejection condition of each ink is as follows.

White-based Ink: Resolution 1440×720 dpi, 100% duty

Color Ink: Resolution 1440×720 dpi, 10% duty

Resin ink: Resolution 1440×720 dpi, 20% duty

As the printing medium, the same as that of Example 1 was used.

2.3.9 Comparative Example 1

The assessment sample of Comparative Example 1 was produced by the condition f.

First Image Printing Mode

Specifically, first, the white-based ink was ejected to print the white image formed of the white-based ink in the first area and the second area of the printing medium. The printing of the image to the first area and the second area were performed at the time of the same carriage scan.

Sixth Image Printing Mode

The printing medium on which the white image obtained as described above was printed was transported to the printer again. The color ink was ejected to print the color image formed of the color ink on the white image of the first area.

The image-printed printing medium was dried by the heater provided in the printer. The heater temperature of the printer was set to 45° C. The surface temperature of the printing medium in the vicinity of the printer head was measured during the printing of the image, and the surface temperature of the printing medium was substantially the same as the set temperature of the printer heater.

In such a manner, the assessment sample of Comparative Example 1 was obtained. In any image, a solid pattern was printed. The ejection condition of each ink is as follows.

White-based Ink: Resolution 1440×720 dpi, 100% duty

Color Ink: Resolution 1440×720 dpi, 10% duty

As the printing medium, the same as that of Example 1 was used.

2.3.10. Comparative Example 2

The assessment sample of Comparative Example 2 was produced in the same manner as that of Comparative Example 1, except that the duty of the color ink was 100%. Accordingly, the assessment sample of Comparative Example 2 was obtained.

2.3.11. Comparative Example 3

The assessment sample of Comparative Example 3 was produced by the condition g.

First Image Printing Mode

Specifically, first, the white-based ink was ejected to print the white image formed of the white-based ink in the first area and the second area of the printing medium. The printing of the image to the first area and the second area were performed at the time of the same carriage scan.

Sixth Image Printing Mode

The printing medium on which the white image obtained as described above was printed was transported to the printer again. The color ink was ejected to print the color image formed of the color ink on the white image of the first area.

Other Image Printing Modes

The printing medium on which the white image and the color image obtained as described above were printed was transported to the printer again. The resin ink was ejected to print the clear image formed of the resin ink on the color image of the first area and the white image of the second area.

The image-printed printing medium was dried by the heater provided in the printer. The heater temperature of the printer was set to 45° C. The surface temperature of the printing medium in the vicinity of the printer head was measured during the printing of the image, and the surface temperature of the printing medium was substantially the same as the set temperature of the printer heater.

In such a manner, the assessment sample of Comparative Example 3 was obtained. In any image, a solid pattern was printed. The ejection condition of each ink is as follows.

White-based Ink: Resolution 1440×720 dpi, 100% duty

Color Ink: Resolution 1440×720 dpi, 10% duty

Resin ink: Resolution 1440×720 dpi, 20% duty

As the printing medium, the same as that of Example 1 was used.

2.3.12. Comparative Example 4

The assessment sample of Comparative Example 4 was produced in the same manner as that of Comparative Example 3, except that the duty of the color ink was 80%. Accordingly, the assessment sample of Comparative Example 4 was obtained.

2.3.13. Comparative Example 5

The assessment sample of Comparative Example 5 was produced in the same manner as that of Example 2, except that the duty of the color ink was 5%. Accordingly, the assessment sample of Comparative Example 5 was obtained.

2.4. Assessment Test 2.4.1. Assessment of Abrasion Resistance of First Area

The obtained assessment samples were dried in a thermostatic bath of 50° C. for 10 minutes. Thereafter, an abraser provided with a white cotton cloth for abrasion (Kanakin No. 3) and the first area of the printing medium were adjusted in a condition of load of 200 g and the number of abrasion times of 10 using a JSPS type abrasion robust tester AB-301 (manufactured by Tester Sangyo Co., Ltd.), and the surface state of the image was visually observed. The assessment reference was as follows.

A: there is no scratch and peeling on printed face

B: scratch is recognized but there is no peeling on printed face

C: scratch and peeling are recognized on printed face 2.4.2. Assessment of Abrasion Resistance of Second Area The assessment test of the abrasion resistance of the second area of the printing medium was performed in the same condition as that of the assessment of the abrasion resistance of the first area. The assessment reference was as follows.

A: there is no scratch and peeling on printed face

B: scratch is recognized but there is no peeling on printed face

C: scratch and peeling are recognized on printed face 2.4.3. Assessment of Printing Speed The assessment of the printing speed was performed by counting the number of transports of the printing medium. The assessment reference was as follows.

A: number of transports once

B: number of transports twice

C: number of transports three times 2.5. Assessment Result

The assessment result described above is shown in Table 1 and Table 2.

In the tables, "T1 (mg/in$^2$)" represents the total weight of the resin included in the image printed on the white image of the first area. In the tables, "T2 (mg/in$^2$)" represents the total weight of the resin included in the image printed on the white image of the second area. T1 and T2 were calculated by multiplying the amount of ejected ink (15 mg/in$^2$) at the duty of 100% by the duty value and the resin content ratio in the ink.

The numerical value in parentheses at the sections of T2 of Example 6 to Example 8 in Table 1 represents the total weight (mg/in$^2$) of the resin derived from the resin ink.

TABLE 1

| | | Ex. 1 | | | Ex. 2 | | | Ex. 3 | | | Ex. 4 | | |
|---|---|---|---|---|---|---|---|---|---|---|---|---|---|
| | Ink Type | W Ink | Co Ink | Cl Ink | W Ink | Co Ink | Cl Ink | W Ink | Co Ink | Cl Ink | W Ink | Co Ink | Cl Ink |
| Ink Comp. | Titanium Dioxide Pigment | 10% | — | — | 10% | — | — | 10% | — | — | 10% | — | — |
| | Cyan Pigment | — | 4% | — | — | 4% | — | — | 4% | — | — | 4% | — |
| | Polyester Resin | 3% | — | — | 3% | — | — | 3% | — | — | 3% | — | — |
| | Acrylic Styrene Resin | 1% | 1% | 6% | 1% | 1% | 6% | 1% | 1% | 6% | 1% | 1% | 6% |
| | Polyethylene Wax | 1% | 1% | 2% | 1% | 1% | 2% | 1% | 1% | 2% | 1% | 1% | 2% |
| | 1,2-hexanediol | 5% | 5% | 5% | 5% | 5% | 5% | 5% | 5% | 5% | 5% | 5% | 5% |
| | 2-pyrrolidone | 2% | 2% | 2% | 2% | 2% | 2% | 2% | 2% | 2% | 2% | 2% | 2% |
| | Surfactant | 1% | 1% | 1% | 1% | 1% | 1% | 1% | 1% | 1% | 1% | 1% | 1% |
| | Propylene glycol | 10% | 10% | 14% | 10% | 10% | 14% | 10% | 10% | 14% | 10% | 10% | 14% |
| | Water | Rem. | Rem. | Rem. | Rem. | Rem. | Rem. | Rem. | Rem. | Rem. | Rem. | Rem. | Rem. |
| | Total | 100% | 100% | 100% | 100% | 100% | 100% | 100% | 100% | 100% | 100% | 100% | 100% |
| Printing Condition | Duty (%) | 100 | 10 | 20 | 100 | 10 | 20 | 100 | 50 | 20 | 100 | 60 | 20 |
| | Printing Mode | | a | | | b | | | b | | | b | |
| First Area | T1 (g) | | 0.27 | | | 0.03 | | | 0.15 | | | 0.18 | |
| | Abrasion Resistance | | A | | | B | | | B | | | A | |
| Second Area | T2 (g) | | 0.24 | | | 0.24 | | | 0.24 | | | 0.24 | |
| | Abrasion Resistance | | A | | | A | | | A | | | A | |
| | Printing Speed | | B | | | B | | | B | | | B | |

| | | Ex. 5 | | | Ex. 6 | | | Ex. 7 | | | Ex. 8 | | |
|---|---|---|---|---|---|---|---|---|---|---|---|---|---|
| | Ink Type | W Ink | Co Ink | Cl Ink | W Ink | Co Ink | Cl Ink | W Ink | Co Ink | Cl Ink | W Ink | Co Ink | Cl Ink |
| Ink Comp. | Titanium Dioxide Pigment | 10% | — | — | 10% | — | — | 10% | — | — | 10% | — | — |
| | Cyan Pigment | — | 4% | — | — | 4% | — | — | 4% | — | — | 4% | — |
| | Polyester Resin | 3% | — | — | 3% | — | — | 3% | — | — | 3% | — | — |
| | Acrylic Styrene Resin | 1% | 1% | 6% | 1% | 1% | 6% | 1% | 1% | 6% | 1% | 1% | 6% |
| | Polyethylene Wax | 1% | 1% | 2% | 1% | 1% | 2% | 1% | 1% | 2% | 1% | 1% | 2% |
| | 1,2-hexanediol | 5% | 5% | 5% | 5% | 5% | 5% | 5% | 5% | 5% | 5% | 5% | 5% |
| | 2-pyrrolidone | 2% | 2% | 2% | 2% | 2% | 2% | 2% | 2% | 2% | 2% | 2% | 2% |
| | Surfactant | 1% | 1% | 1% | 1% | 1% | 1% | 1% | 1% | 1% | 1% | 1% | 1% |
| | Propylene glycol | 10% | 10% | 14% | 10% | 10% | 14% | 10% | 10% | 14% | 10% | 10% | 14% |
| | Water | Rem. | Rem. | Rem. | Rem. | Rem. | Rem. | Rem. | Rem. | Rem. | Rem. | Rem. | Rem. |
| | Total | 100% | 100% | 100% | 100% | 100% | 100% | 100% | 100% | 100% | 100% | 100% | 100% |
| Printing Condition | Duty (%) | 100 | 100 | 20 | 100 | 10 | 20 | 100 | 100 | 20 | 100 | 10 | 20 |
| | Printing Mode | | b | | | c | | | d | | | e | |
| First Area | T1 (g) | | 0.3 | | | 0.27 | | | 0.3 | | | 0.27 | |
| | Abrasion Resistance | | A | | | A | | | A | | | A | |
| Second Area | T2 (g) | | 0.24 | | | 0 (+0.24 simultaneous) | | | 0 (+0.24 simultaneous) | | | 0 (+0.24 simultaneous) | |
| | Abrasion Resistance | | A | | | B | | | B | | | B | |
| | Printing Speed | | B | | | B | | | B | | | B | |

TABLE 2

| | | Comp. Ex. 1 | | Comp. Ex. 2 | | Comp. Ex. 3 | | | Comp. Ex. 4 | | | Comp. Ex. 5 | | |
|---|---|---|---|---|---|---|---|---|---|---|---|---|---|---|
| Ink Type | | W Ink | Co Ink | W Ink | Co Ink | W Ink | Co Ink | Cl Ink | W Ink | Co Ink | Cl Ink | W Ink | Co Ink | Cl Ink |
| Ink Comp. | Titanium Dioxide Pigment | 10% | — | 10% | — | 10% | — | — | 10% | — | — | 10% | — | — |
| | Cyan Pigment | — | 4% | — | 4% | — | 4% | — | — | 4% | — | — | 4% | — |
| | Polyester Resin | 3% | — | 3% | — | 3% | — | — | 3% | — | — | 3% | — | — |
| | Acrylic Styrene Resin | 1% | 1% | 1% | 1% | 1% | 1% | 6% | 1% | 1% | 6% | 1% | 1% | 6% |
| | Polyethylene Wax | 1% | 1% | 1% | 1% | 1% | 1% | 2% | 1% | 1% | 2% | 1% | 1% | 2% |
| | 1,2-hexanediol | 5% | 5% | 5% | 5% | 5% | 5% | 5% | 5% | 5% | 5% | 5% | 5% | 5% |
| | 2-pyrrolidone | 2% | 2% | 2% | 2% | 2% | 2% | 2% | 2% | 2% | 2% | 2% | 2% | 2% |
| | Surfactant | 1% | 1% | 1% | 1% | 1% | 1% | 1% | 1% | 1% | 1% | 1% | 1% | 1% |
| | Propylene glycol | 10% | 10% | 10% | 10% | 10% | 10% | 14% | 10% | 10% | 14% | 10% | 10% | 14% |
| | Water | Rem. | Rem. | Rem. | Rem. | Rem. | Rem. | Rem. | Rem. | Rem. | Rem. | Rem. | Rem. | Rem. |
| | Total | 100% | 100% | 100% | 100% | 100% | 100% | 100% | 100% | 100% | 100% | 100% | 100% | 100% |
| Printing Condition | Duty (%) | 100% | 10% | 100% | 100% | 100% | 10% | 20% | 100% | 80% | 20% | 100% | 5% | 20% |
| | Printing Mode | f | | f | | | g | | | g | | | b | |
| First Area | T1 (g) | 0.03 | | 0.3 | | | 0.27 | | | 0.54 | | | 0.015 | |
| | Abrasion Resistance | B | | A | | | A | | | A | | | C | |
| Second Area | T2 (g) | 0 | | 0 | | | 0.24 | | | 0.24 | | | 0.24 | |
| | Abrasion Resistance | C | | C | | | A | | | A | | | A | |
| Printing Speed | | B | | B | | | C | | | C | | | B | |

As shown in the assessment result of Table 1 and Table 2, the images (the images printed in the first area and the second area of the printing medium) obtained by producing the assessment samples of Example 1 to Example 8 had excellent abrasion resistance and were satisfactory. In all the productions of the assessment samples of Example 1 to Example 8, the transport of the printing medium was performed twice, and it was possible to perform it at high speed.

Meanwhile, in Comparative Example 1 and Comparative Example 2, the images were printed using the condition f. In the condition f, the resin ink is not used to form the white image of the second area, and the clear image is not printed on the white image formed on the second area. For this reason, the abrasion resistance of the white image in the second area was not excellent.

In Comparative Example 3 and Comparative Example 4, the images were printed using the condition g. In the condition g, in the printing of the image, the printing medium is transported three times. For this reason, the printing speed was not excellent.

In Comparative Example 5, the image was printed using the condition b. However, the total weight (T1) of the resin included in the color image printed on the white image of the first area was less than 0.03 mg/in$^2$. For this reason, it was possible to obtain prints in which the abrasion resistance of the color image is not excellent.

The invention is not limited to the embodiments described above, and may be variously modified. For example, the invention includes substantially the same configuration (for example, the configuration in which functions, methods, and results are the same, or the configuration in which objects and effects are the same) as the configuration described in the embodiments. The invention includes a configuration in which an unessential part of the configuration described in the embodiments is transferred. The invention includes a configuration having the same operational effect as that of the configuration described in the embodiment or a configuration capable of achieving the same object. The invention includes a configuration in which the known art is added to the configuration described in the embodiments.

What is claimed is:

1. An ink jet printing apparatus comprising:

a head that is provided with nozzle holes for ejecting ink; and a control unit that performs a plurality of modes, wherein the plurality of modes includes:

a first image printing mode of ejecting a white-based ink composition from the nozzle holes to adhere the white-based ink composition to a first area of a printing medium and a second area different from the first area to print an image; and a second image printing mode of substantially concurrently ejecting a color ink composition and a resin ink composition from the nozzle holes to contact and adhere the color ink composition and the resin ink composition onto the white-based ink composition of the first area to print an image, and ejecting the resin ink composition from the nozzle holes to adhere the resin ink composition onto the white-based ink composition of the second area to print an image, wherein the white-based ink composition contains a white-based color material, the color ink composition contains resin and a color material other than the white-based color material, and the resin ink composition contains resin, and does not substantially contain a color material.

2. An ink jet printing apparatus comprising:

a head that is provided with nozzle holes for ejecting ink; and a control unit that performs a plurality of modes, wherein the plurality of modes includes:

a fourth image printing mode of ejecting a white-based ink composition from the nozzle holes to adhere the white based ink composition to a first area of a printing medium to print an image, and substantially concurrently ejecting the white-based ink composition and a resin ink composition from the nozzle holes to contact and adhere the white-based ink composition and the resin ink composition to a second area of the printing medium different from the first area to print an image; and a fifth image printing mode of substantially concurrently ejecting a color ink composition and the resin ink composition from the nozzle holes to contact and adhere the color ink composition and the resin ink composition onto the white-based ink composition of the first area to print an image, wherein the white-based ink composition contains a white-based color material, the color ink composition contains resin and a color material other than the white-based color material, and the resin ink composition contains resin, and does not substantially contain a color material.

3. An ink jet printing apparatus comprising:

a head that is provided with nozzle holes for ejecting ink; and a control unit that controls and performs a plurality of modes, wherein the plurality of modes includes:

a seventh image printing mode of substantially concurrently ejecting a white-based ink composition and a resin ink composition from the nozzle holes to contact and adhere the white-based ink composition and the resin ink composition to a first area of the printing medium and a second area of the printing medium different from the first area; and an eighth image printing mode of substantially concurrently ejecting a color ink composition and the resin ink composition from the nozzle holes to contact and adhere the color ink composition and the resin ink composition onto the white-based ink composition and the resin ink composition of the first area to print an image, wherein the white-based ink composition contains a white-based color material, the color ink composition contains resin and a color material other than the white-based color material, and the resin ink composition contains resin, and does not substantially contain a color material.

4. The ink jet printing apparatus according to claim 1, further comprising:

a carriage that scans the head in a main scanning direction, wherein in the second image printing mode, the printing of the image in the first area and the printing of the image in the second area are performed at the time of the same carriage scan.

5. The ink jet printing apparatus according to claim 4, further comprising:

a first nozzle row that is formed by arranging the plurality of nozzle holes for ejecting the white-based ink composition in a sub-scanning direction intersecting the main scanning direction;

a second nozzle row that is formed by arranging the plurality of nozzle holes for ejecting the color ink composition in the sub-scanning direction; and a third nozzle row that is formed by arranging the plurality of nozzle holes for ejecting the resin ink composition in the sub-scanning direction, wherein the first nozzle row, the second nozzle row, and the third nozzle row are divided into groups including a predetermined number of nozzle holes in the sub-scanning direction, wherein the group includes a first group on the upstream side in the sub-scanning direction and a second group further to the downstream side in the sub-scanning direction than the first group, wherein the first image printing mode is performed by ejecting the white-based ink composition from the first group of the first nozzle row, and wherein the second image printing mode is performed by ejecting the color ink composition from the second group of the second nozzle row, and ejecting the resin ink composition from the second group of the third nozzle row.

6. The ink jet printing apparatus according to claim 1, wherein the plurality of mode further includes a third image printing mode of ejecting the color ink composition from the nozzle holes to adhere the color ink composition onto the white-based ink composition of the first area to print an image, and ejecting the resin ink composition from the nozzle holes to adhere the resin ink composition onto the white-based ink composition of the second area to print an image, and wherein the third image printing mode is performed instead of the second image printing mode when the amount of the resin in the color ink composition adhered to the first area is equal to or more than 0.03 mg/in$^2$.

7. The ink jet printing apparatus according to claim 2, further comprising a carriage that scans the head in the main scanning direction, wherein in the fourth image printing mode, the printing of the image in the first area and the printing of the image in the second area are performed at the time of the same carriage scan.

8. The ink jet printing apparatus according to claim 7, further comprising:

a first nozzle row that formed by arranging the plurality of nozzle holes for ejecting the white-based ink composition in a sub-scanning direction intersecting the main scanning direction;

a second nozzle row that is formed by arranging the plurality of nozzle holes for ejecting the color ink composition in the sub-scanning direction; and a third nozzle row that is formed by arranging the plurality of nozzle holes for ejecting the resin ink composition in the sub-scanning direction, wherein the first nozzle row, the second nozzle row, and the third nozzle row are divided into groups including a predetermined number of nozzle holes in the sub-scanning direction, wherein the group includes a first group on the upstream side in the sub-scanning direction and a second group further to the downstream side in the sub-scanning direction than the first group, wherein the fourth image printing mode is performed by ejecting the white-based ink composition from the first group of the first nozzle row, and ejecting the resin ink composition from the first group of the third nozzle row, and wherein the fifth image printing mode is performed by ejecting the color ink composition from the second group of the second nozzle row, and ejecting the resin ink composition from the second group of the third nozzle row.

9. The ink jet printing apparatus according to claim 2, wherein the plurality of modes further includes a sixth image printing mode of ejecting the color ink composition from the nozzle holes to adhere the color ink composition onto the white-based ink composition of the first area to print an image, and wherein the sixth image printing mode is performed instead of the fifth image printing mode when the amount of the resin in the color ink composition adhered to the first area is equal to or more than 0.03 mg/in$^2$.

10. The ink jet printing apparatus according to claim 3, further comprising:

a carriage that scans the head in a main scanning direction;

a first nozzle row that is formed by arranging the plurality of nozzle holes for ejecting the white-based ink composition in a sub-scanning direction intersecting the main scanning direction; and a second nozzle row that is formed by arranging the plurality of nozzle holes for ejecting the color ink composition in the sub-scanning direction, and a third nozzle row that is formed by arranging the plurality of nozzle holes for ejecting the resin ink composition in the sub-scanning direction, wherein the first nozzle row, the second nozzle row, and the third nozzle row are divided into groups including a predetermined number of nozzle holes in the sub-scanning direction, wherein the group includes a first group on the upstream side in the sub-scanning direction and a second group further to the downstream side in the sub-scanning direction than the first group, wherein the seventh image printing mode is performed by ejecting the white-based ink composition from the first group of the first nozzle row, and ejecting the resin ink composition from the first group of the third nozzle row, and wherein the eighth image printing mode is performed by ejecting the color image composition from the second group of the second nozzle row, and ejecting the resin ink composition from the second group of the third nozzle row.

11. The ink jet printing apparatus according to claim 3, wherein the plurality of modes further includes a ninth image printing mode of ejecting the color ink composition from the nozzle holes to adhere the color ink composition onto the white-based ink composition and the resin ink composition of the first area to print an image, and wherein the ninth image printing mode is performed instead of the eighth image printing mode when the amount of the resin in the color ink composition adhered to the first area is equal to or more than 0.03 mg/in$^2$.

12. The ink jet printing apparatus according to claim 1, wherein an amount of the resin contained in the resin ink composition is approximately in the range of about 1 mass % to about 15 mass % with respect to the total mass of the resin ink composition.

13. The ink jet printing apparatus according to claim 1, wherein an amount of the resin contained in the color ink composition is approximately in the range of about 1 mass % to about 7 mass % with respect to the total mass of the color ink composition.

14. The ink jet printing apparatus according to claim 1, wherein the resin ink composition further contains polyolefin wax.

15. The ink jet printing apparatus according to claim 2, wherein an amount of the resin contained in the resin ink composition is approximately in the range of about 1 mass % to about 15 mass % with respect to the total mass of the resin ink composition.

16. The ink jet printing apparatus according to claim 2, wherein an amount of the resin contained in the color ink composition is approximately in the range of about 1 mass % to about 7 mass % with respect to the total mass of the color ink composition.

17. The ink jet printing apparatus according to claim 2, wherein the resin ink composition further contains polyolefin wax.

18. The ink jet printing apparatus according to claim 3, wherein an amount of the resin contained in the resin ink composition is approximately in the range of about 1 mass % to about 15 mass % with respect to the total mass of the resin ink composition.

19. The ink jet printing apparatus according to claim 3, wherein an amount of the resin contained in the color ink composition is approximately in the range of about 1 mass % to about 7 mass % with respect to the total mass of the color ink composition.

20. The ink jet printing apparatus according to claim 3, wherein the resin ink composition further contains polyolefin wax.

* * * * *